US010242632B2

(12) United States Patent
Ota et al.

(10) Patent No.: US 10,242,632 B2
(45) Date of Patent: Mar. 26, 2019

(54) DISPLAY CONTROL DEVICE AND DISPLAY PANEL MODULE

(71) Applicant: Synaptics Japan GK, Tokyo (JP)

(72) Inventors: Shigeru Ota, Tokyo (JP); Atsushi Shikata, Tokyo (JP); Go Toyoda, Tokyo (JP); Makoto Takeuchi, Toyko (JP)

(73) Assignee: Synaptics Japan GK, Tokyo (JP)

( * ) Notice: Subject to any disclaimer, the term of this patent is extended or adjusted under 35 U.S.C. 154(b) by 38 days.

(21) Appl. No.: 15/649,911

(22) Filed: Jul. 14, 2017

(65) Prior Publication Data

US 2018/0025691 A1 Jan. 25, 2018

(30) Foreign Application Priority Data

Jul. 20, 2016 (JP) ..... 2016-142366

(51) Int. Cl.
*G09G 3/36* (2006.01)
*G09G 3/34* (2006.01)

(52) U.S. Cl.
CPC ..... *G09G 3/36* (2013.01); *G09G 3/3413* (2013.01); *G09G 3/364* (2013.01); *G09G 2320/0666* (2013.01)

(58) Field of Classification Search
CPC ..... G09G 3/36; G09G 3/3413; G09G 2320/0666; G09G 3/364
See application file for complete search history.

(56) References Cited

U.S. PATENT DOCUMENTS 9,583,066 B2 * 2/2017 Jiang ..... G09G 3/3681
2008/0278467 A1 * 11/2008 Hwang ..... G09G 3/3648 345/205
2009/0244052 A1 * 10/2009 Takahashi ..... G09G 3/3688 345/213
2010/0097367 A1 * 4/2010 Kitayama ..... G09G 3/3614 345/213
2012/0044225 A1 * 2/2012 Kim ..... G09G 3/3614 345/209
2012/0327137 A1 * 12/2012 Saitoh ..... G09G 3/3648 345/690
2013/0100122 A1 * 4/2013 Moon ..... G09G 3/003 345/419
2015/0116247 A1 4/2015 Inoue et al.
2016/0012791 A1 * 1/2016 Hsieh ..... G09G 3/3648 345/98
2016/0182042 A1 * 6/2016 Kim ..... G09G 3/3225 345/213
2016/0322012 A1 * 11/2016 Oh ..... G09G 3/3648
2017/0052635 A1 * 2/2017 Yu ..... G06F 3/044

* cited by examiner

*Primary Examiner* — Ibrahim A Khan
(74) *Attorney, Agent, or Firm* — Patterson + Sheridan, LLP

(57) ABSTRACT

A halt period is inserted between a drive period in an odd-numbered field and a drive period in an even-numbered field in interlace driving. When drive signals driving subpixels are time-divisionally supplied to the display panel in units of subpixel types, switch control signals controlling source line switches which distribute the drive signals associated with respective subpixels to the corresponding source lines are generated so that the number of switching of the source line switches are reduced.

16 Claims, 16 Drawing Sheets

INTERVAL INTERLACE MODE

DISPLAY CONTROL DEVICE AND DISPLAY PANEL MODULE

CROSS REFERENCE

This application claims priority of Japanese Patent Application No. 2016-142366, filed on Jul. 20, 2016, the disclosure of which is incorporated herein by reference.

TECHNICAL FIELD

The present invention relates to a display control device adapted to interlace driving of a display panel, especially suitable for use in a display panel module incorporating a display panel and a display control device driving the display panel.

BACKGROUND ART

The interlace driving is one known technique for driving the gate lines and source lines of a display panel. The interlace driving involves alternately driving odd-numbered gate lines associated with odd-numbered fields and even-numbered gate lines associated with even-numbered fields associated with even-numbered gate lines; in the interlace driving, each frame includes two fields, one is an odd-numbered field and the other is an even-numbered field. The interlace driving have been considered as a technique which allows increasing the number of times of image drawing without increasing the transmission data amount in image data transfer (more specifically, without increasing the transmission rate or transmission band width), compared with non-interlace driving, which involves sequential selection of the gate lines in image displaying. Japanese Patent Application Publication No. 2015-111400 A discloses an interlace driving method for a liquid crystal display panel.

The interlace driving, which effectively avoids an increase in the transmission rate or transmission band width of image data, tends to increase the power consumption due to an increase in the number of times of image drawing. The increase in power consumption is one issue of recent systems including display panels of high definition, such as FHD (full high definition) panels or those with higher definition, therefore reduction in the power consumption is an urgent requirement of a display control device. From this background, the inventors have committed a study for reducing power consumption in interlace driving.

SUMMARY

Examples described herein reduce power consumption in interlace driving of a display panel.

This and other advantages and new features of the present invention will be understood from the following description and attached drawings.

Given below is an overview of a representative embodiment disclosed in this application. In one embodiment, a halt period is inserted between a drive period of an odd-numbered field and a drive period of an even-numbered field in interlace driving. In one embodiment, when drive signals driving subpixels are time-divisionally supplied to the display panel in units of subpixel types, switch control signals controlling source line switches which distribute the drive signals associated with respective subpixels to the corresponding source lines are switched so that the number of switching of the source line switches are reduced.

DETAILED DESCRIPTION OF PREFERRED EMBODIMENTS

Figure 1:
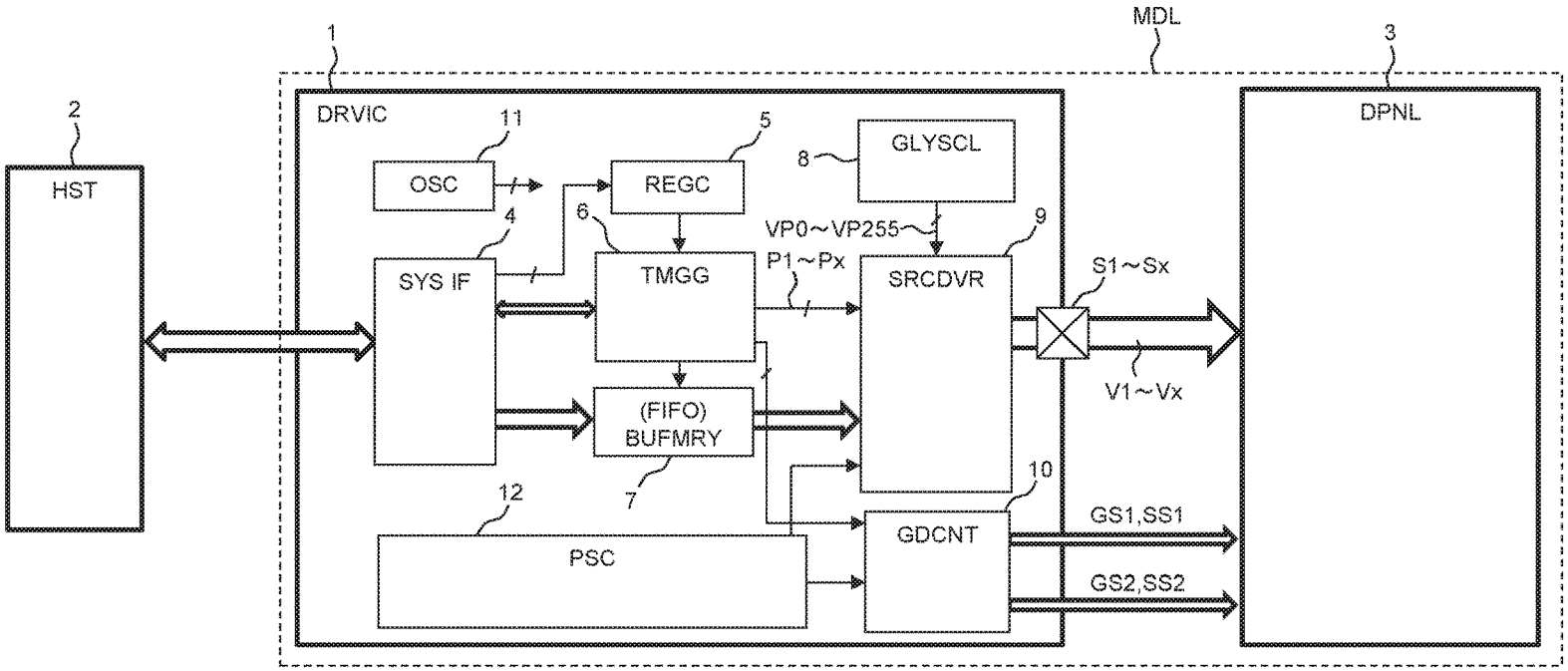
FIG. 1 is a block diagram illustrating one example of a display control device.

Preferred embodiments will be specifically described in the following. It should be noted that, in the following section, reference numerals appearing in the attached drawings may be recited in parentheses to indicate examples of corresponding elements in the drawings, only for easiness of understanding.

[1] Interval Interlace Mode

A display control device (1) includes: a gate line controller (10) configured control selection of gate lines (G1 to Gn) of a display panel (3) in synchronization with display timing; a source driver (9) configured to supply drive signals to source lines (S1_R to Sx_B) arranged to intersect the gate lines of the display panel; and a control circuitry (6) configured to control the gate line controller and the source driver. The gate line controller separately outputs odd-numbered gate line control signals (GS1) used for controlling selection of odd-numbered gate lines of the display panel and even-numbered gate line control signals (GS2) used for controlling selection of even-numbered gate lines. The control circuitry is configured to perform, in response to a non-interlace mode being specified, a control to sequentially activate the odd-numbered gate line control signals and the even-numbered gate line control signals in units of gate lines, perform, in response to an interlace mode being specified, a control to alternately provide odd field periods (ACTodd) and even field periods (ACTevn) and perform, in response to an interval interlace mode being specified, a control to provide a gate halt period between adjacent two of the odd- and even field periods which are alternately provided. In the odd field periods, the odd-numbered gate line control signals are sequentially activated with the even-numbered gate line control signals deactivated. In the even field periods, the even-numbered gate line control signals are sequentially activated with the odd-numbered gate line control signals deactivated. In the gate halt period, the odd- and even-numbered gate line control signals are both deactivated.

This scheme effectively reduces the power consumption per unit time of the display control device through the use of the interval interlace mode, in which the odd- and even-numbered gate line control signals are both deactivated in the gate halt period (STP) disposed between adjacent two of the odd- and even field periods which are alternately provided.

[2] Halt of Supply of Power Supply Voltage to Source driver in Gate Halt Period

In relation to item [1], the control circuitry may perform a control to halt of supply of a power supply voltage to the source driver in the gate halt period.

This allows further reducing the power consumption per unit time in the interval interlace mode.

[3] Halt of Supply of Power Supply Voltage to Source Driver in Deactivation Period of Gate Line Control Signals in Interlace Mode and Interval Interlace Mode In relation to item [1], the control circuitry may perform a control to, when any one of the interlace mode and the interval interlace mode is specified, halt the supply of the power supply voltage to the source driver in a period in which the even-numbered gate line control signals are deactivated in each of the odd field periods, and halt the supply of the power supply voltage to the source driver in a period in which the odd-numbered gate line control signals are deactivated in each of the even field periods.

This allows further reducing the power consumption per unit time in the interval interlace mode.

[4] Control of Duration of Gate Halt Period

In relation to item [1], the display control device may further include a halt period setting register circuit (5) to which a gate halt period data (STPP) is rewritably set. In this case, the control circuitry preferably controls the duration of the gate halt period in response to the gate halt period data set to the halt period setting register.

This allows variably setting the duration of the gate halt period in accordance with the necessity.

[5] Gate Control Signals

In relation to item [1], the odd-numbered gate line control signals may include multi-phase odd shift clock signals (ODD_CLK1, ODD_CLK2) for sequentially shifting an odd shift data from a first stage to a final stage of an odd shift register, the odd shift data being used for selection of the odd-numbered gate lines, and the even-numbered gate line control signals may include multi-phase even shift clock signals (EVN_CLK1, EVN_CLK2) for sequentially shifting an even shift data from a first stage to a final stage of an even shift register. In this case, the deactivation of the gate line control signals may be achieved by stopping the switching of the signal levels of the shift clock signals.

In this scheme, the selection of the gate lines can be achieved by controlling the shifting of the shift data with the shift clock signals, while the deactivation of the gate control signals can be easily achieved by stopping the switching of the signal levels of the shift clock signals.

[6] Output Synchronization Signal Enabled for a Period Bridging Adjacent Display Periods Associated with Adjacent Gate Lines In relation to item [1], the source driver may time-divisionally output drive signals to subpixels associated with each gate line from drive terminals (S1 to Sx), in units of subpixel types in each display period (Hodd, Hevn) associated with each gate line, and the gate line controller may output output synchronization signals (ODD_SW1 to ODD_SW3, EVN_SW1 to EVN_SW3) each specifying an output period in which the drive signals for corresponding one of the subpixel types are to be time-divisionally output from the drive terminals. In this case, in all of the non-interlace mode, interlace mode and the interval interlace mode, the control circuitry may preferably perform a control to first enable the output synchronization signal which has been last enabled in a display period (Hodd, Hevn) associated with a specific gate line, in the display period associated with the gate line next to the specific gate line, so that the output synchronization signal which has been last enabled in the display period associated with the specific gate line remains enabled until the beginning of the display period associated with the gate line next to the specific gate line.

This allows reducing the number of switching of the source line switches which distribute the drive signals associated with the subpixels to the corresponding source lines when the drive signals are time-divisionally supplied to the display panel in units of subpixel types. In other words, the number of charging and discharging of the signal lines transmitting the switch control signals of the source line switches are effectively reduced by continuously enabling the output synchronization signal which have been last enabled in a display period associated with a specific gate line in the display period associated with the gate line next to the specific gate line.

[7] Setting of Output Synchronization Signals for Interlace Mode and Interval Interlace Mode In relation to item [6], in response to the interlace mode or interval interlace mode being specified, the control circuitry performs a control to, in each of the odd field periods, first enable the output synchronization signal which has been last enabled in the display period (Hodd) associated with each of the odd-numbered gate lines, in the display period associated with the next odd-numbered gate line, so that the output synchronization signal which has been last enabled in the display period associated with each of the odd-numbered gate lines remain enabled until the display period associated with the next odd-numbered gate line, and in each of the even field periods, first enable the output synchronization signal which has been last enabled in the display period (Hevn) associated with each of the even-numbered gate lines in the display period associated with the next even-numbered gate line, so that the output synchronization signal which has been last enabled in the display period associated with each of the even-numbered gate lines remain enabled until the display period associated with the next even-numbered gate line.

This achieves a similar advantage to item [6] for both of the interlace mode and the interval interlace mode.

[8] Interval Interlace Mode

In another embodiment, a display panel module includes: a display panel (3) and a display control device (1). The display control device includes a gate line controller (10) configured to control selection of gate lines (G1 to Gn) of the display panel in synchronization with display timing; a source driver (9) configured to supply drive signals in parallel to source lines (S1_R to Sx_B) arranged to intersect the gate lines of the display panel; and a control circuitry (6) configured to control the gate line controller and the source driver. The gate line controller separately outputs odd-numbered gate line control signals (GS1) used to for controlling selection of odd-numbered gate lines of the display panel and even-numbered gate line control signals (GS2) used for controlling selection of even-numbered gate lines. The control circuitry is configured to perform, in response to a non-interlace mode being specified, a control to sequentially activate the odd-numbered gate line control signals and the even-numbered gate line control signals in units of gate lines, perform, in response to an interlace mode being specified, a control to alternately provide odd field periods (ACTodd) and even field periods (ACTevn) and perform, in response to an interval interlace mode being specified, a control to provide a gate halt period between adjacent two of the odd and even field periods which are alternately provided. In the odd field periods, the odd-numbered gate line control signals are sequentially activated with the even-numbered gate line control signals deactivated. In the even field periods, the even-numbered gate line control signals are sequentially activated with the odd-numbered gate line control signals deactivated. In the gate halt period, the odd- and even-numbered gate line control signals are both deactivated.

This achieves a similar advantage to item [1].

[9] Halt of Supply of Power Supply Voltage to Source Driver in Gate Halt Period

In relation to item [8], the control circuitry may perform a control to halt of supply of a power supply voltage to the source driver in the gate halt period.

This achieves a similar advantage to item [2].

[10] Halt of Supply of Power Supply Voltage to Source Driver in Deactivation Period of Gate Line Control Signals in Interlace Mode and Interval Interlace Mode In relation to item [8], the control circuitry may perform a control to, when any one of the interlace mode and the interval interlace mode is specified, halt the supply of the power supply voltage to the source driver in a period in which the even-numbered gate line control signals are deactivated in each of the odd field periods, and halt the supply of the power supply voltage to the source driver in a period in which the odd-numbered gate line control signals are deactivated in each of the even field periods.

This achieves a similar advantage to item [3].

[11] Control of Duration of Gate Halt Period

In relation to item [8], the display control device may further include a halt period setting register circuit (5) to which a gate halt period data (STPP) is rewritably set. In this case, the control circuitry preferably controls the duration of the halt period in response to the gate halt period data set to the halt period setting register.

This achieves a similar advantage to item [4].

[12] Gate Control Signals

In relation to item [8], the display panel may include an odd gate driver (21) configured to select odd-numbered gate lines in response to shift data shifted over an odd shift register; and an even gate driver (22) configured to select even-numbered gate lines in response to shift data shifted over an even shift register. In this case, the odd-numbered gate line control signals may include multi-phase odd shift clock signals (ODD_CLK1, ODD_CLK2) for sequentially shifting the odd shift data from a first stage to a final stage of the odd shift register, the odd shift data being used for selection of the odd-numbered gate lines, and the even-numbered gate line control signals may include multi-phase even shift clock signals (EVN_CLK1, EVN_CLK2) for sequentially shifting the even shift data from a first stage to final stage of the even shift register. In a preferable embodiment, the deactivation of the gate line control signals may be achieved by stopping the switching of the signal levels of the shift clock signals.

This achieves a similar advantage to item [5].

[13] Output Synchronization Signal Enabled for a Period Bridging Adjacent Display Periods Associated with Adjacent Gate Lines In relation to item [8], in one embodiment, the source driver time-divisionally outputs drive signals to pixels associated with each gate line from drive terminals (S1 to Sx), in units of subpixel types in each display period associated with each gate line, and the gate line controller outputs output synchronization signals (ODD_SW1 to ODD_SW3, EVN_SW1 to EVN_SW3) each specifying an output period in which the drive signals of a corresponding one of the subpixel types are to be time-divisionally output from the drive terminals, while the display panel includes a source line switch circuit (23) which distributes the drive signals time-divisionally output from the drive terminals to source lines (S1_R, S1_G, S1_B to Sx_R, Sx_G, Sx_B) corresponding to respective subpixels and the source line switch circuit uses the output synchronization signals as switch control signals for the respective subpixel types. In this case, the control circuitry may preferably perform a control to, in all of the non-interlace mode, the interlace mode and the interval interlace mode, first enable the output synchronization signal which have been last enabled in a display period (Hodd, Hevn) associated with a specific gate line in the display period associated with the gate line next to the specific gate line, so that the output synchronization signal which has been last enabled in the display period associated with the specific gate line remains enabled until the beginning of the display period associated with the gate line next to the specific gate line.

This achieves a similar advantage to item [6].

[14] Setting of Output Synchronization Signals for Interlace Mode and Interval Interlace Mode In relation to item [13], in response to the interlace or interval interlace mode being specified, the control circuitry may perform a control to, in each of the odd field periods, first enable the output synchronization signal which has been last enabled in the display period (Hodd) associated with each of the odd-numbered gate lines in the display period associated with the next odd-numbered gate line, so that the output synchronization signal which has been last enabled in the display period associated with each of the odd-numbered gate lines remain enabled until the display period associated with the next odd-numbered gate line, and a control to, in each of the even field periods, first enable the output synchronization signal which has been last enabled in the display period (Hevn) associated with each of the even-numbered gate lines in the display period associated with the next even-numbered gate line, so that the output synchronization signal which has been last enabled in the display period associated with each of the even-numbered gate lines remain enabled until the display period associated with the next even-numbered gate line.

This achieves a similar advantage to item [7].

[15] Distribution of Time-Divisionally Supplied Pixels Signals to Source Lines

In still another embodiment, a display control device (1) includes: gate line controller (10) configured control selection of gate lines (G1 to Gn) of a display panel (3) in synchronization with display timing; a source driver (9) configured to supply drive signals to source lines (S1_R to Sx_B) arranged to intersect the gate lines of the display panel; and a control circuitry (6) configured to control the gate line controller and the source driver. The gate line controller separately outputs odd-numbered gate line control signals used to for controlling selection of odd-numbered gate lines of the display panel and even-numbered gate line control signals used for controlling selection of even-numbered gate lines. The control circuitry is configured to perform, in response to a non-interlace mode being specified, a control to sequentially activate the odd-numbered gate line control signals and the even-numbered gate line control signals in units of gate lines, and perform, in response to an interlace mode being specified, a control to alternately provide odd field periods (ACTodd) and even field periods (ACTevn). In the odd field periods, the odd-numbered gate line control signals are sequentially activated and the activation of even-numbered gate line control signals is masked. In the even field periods, the even-numbered gate line control signals are sequentially activated and the activation of the odd-numbered gate line control signals is masked. The source driver time-divisionally outputs drive signals to subpixels associated with each gate line from drive terminals (S1 to Sx), in units of subpixel types in each display period (Hodd, Hevn) associated with each gate line. the gate line controller outputs output synchronization signals (ODD_SW1 to ODD_SW3, EVN_SW1 to EVN_SW3) each specifying an output period in which the drive signals for corresponding one of the subpixel types are to be time-divisionally output from the drive terminals. In response to the interlace mode or the interval interlace mode being specified, the control circuitry performs a control to, in each of the odd field periods, first enable the output synchronization signal which has been last enabled in the display period (Hodd) associated with each of the odd-numbered gate lines in the display period associated with the next odd-numbered gate line, so that the output synchronization signal which has been last enabled in the display period associated with each of the odd-numbered gate lines remain enabled until the display period associated with the next odd-numbered gate line; and a control to, in each of the even field periods, first enable the output synchronization signal which has been last enable in the display period (Hevn) associated with each of the even-numbered gate lines in the display period associated with the next even-numbered gate line, so that the output synchronization signal which has been last enabled in the display period associated with each of the even-numbered gate lines remain enabled until the display period associated with the next even-numbered gate line.

This allows reducing the number of switching of the source line switches which distribute the drive signals associated with the subpixels to the corresponding source lines when the drive signals are time-divisionally supplied to the display panel in units of subpixel types, for both of the interlace mode and the interval interlace mode. In other words, the number of charging and discharging of the signal lines transmitting the switch control signals of the source line switches are effectively reduced by continuously enabling the output synchronization signal which have been last enabled in a display period associated with a specific gate line, until the beginning of the display period associated with the gate line next to the specific gate line.

[16] Distribution of Time-Divisionally Supplied Pixels Signals to Source Lines

In still another embodiment, a display panel module includes: a display panel (3) and a display control device (1). The display control device includes a gate line controller (10) configured to control selection of gate lines (G1 to Gn) of the display panel in synchronization with display timing; and a source driver (9) configured to supply drive signals in parallel to source lines (S1_R to Sx_B) arranged to intersect the gate lines of the display panel; and a control circuitry (6) configured to control the gate line controller and the source driver. The gate line controller separately outputs odd-numbered gate line control signals (GS1) used to for controlling selection of odd-numbered gate lines of the display panel and even-numbered gate line control signals (GS1) used for controlling selection of even-numbered gate lines. The control circuitry is configured to perform, in response to a non-interlace mode being specified, a control to sequentially activate the odd-numbered gate line control signals and the even-numbered gate line control signals in units of gate lines, and perform, in response to an interlace mode being specified, a control to alternately provide odd field periods (ACTodd) and even field periods (ACTevn). In the odd field periods, the odd-numbered gate line control signals are sequentially activated and the activation of even-numbered gate line control signals is masked. In the even field periods, the even-numbered gate line control signals are sequentially activated and the activation of the odd-numbered gate line control signals is masked. The source driver time-divisionally outputs drive signals to subpixels associated with each gate line from drive terminals (S1 to Sx), in units of subpixel types in each display period (Hodd, Hevn) associated with each gate line. The gate line controller outputs output synchronization signals (ODD_SW1 to ODD_SW3, EVN_SW1 to EVN_SW3) each specifying an output period in which the drive signals for corresponding one of the subpixel types are to be time-divisionally output from the drive terminals. The display panel includes a source line switch circuit (23) which distribute the drive signals time-divisionally output from the drive terminals to source lines (S1_R, S1_G, S1_B to Sx_R, Sx_G, Sx_B) corresponding to respective subpixels, and the source line switch circuit uses the output synchronization signals as switch control signals for the respective subpixel types. The control circuitry performs a control to, in each of the odd field periods, first enable the output synchronization signal which has been last enabled in the display period (Hodd) associated with each of the odd-numbered gate lines in the display period associated with the next odd-numbered gate line, so that the output synchronization signal which has been last enabled in the display period associated with each of the odd-numbered gate lines remain enabled until the display period associated with the next odd-numbered gate line, and a control to, in each of the even field periods, first enable the output synchronization signal which has been last enabled in the display period (Hevn) associated with each of the even-numbered gate lines in the display period associated with the next even-numbered gate line, so that the output synchronization signal which has been last enabled in the display period associated with each of the even-numbered gate lines remain enabled until the display period associated with the next even-numbered gate line.

This achieves a similar advantage to item [15].

In the following, a description is given of more specific embodiments. FIG. 1 exemplarily illustrates a display control device in one embodiment.

Figure 2A:
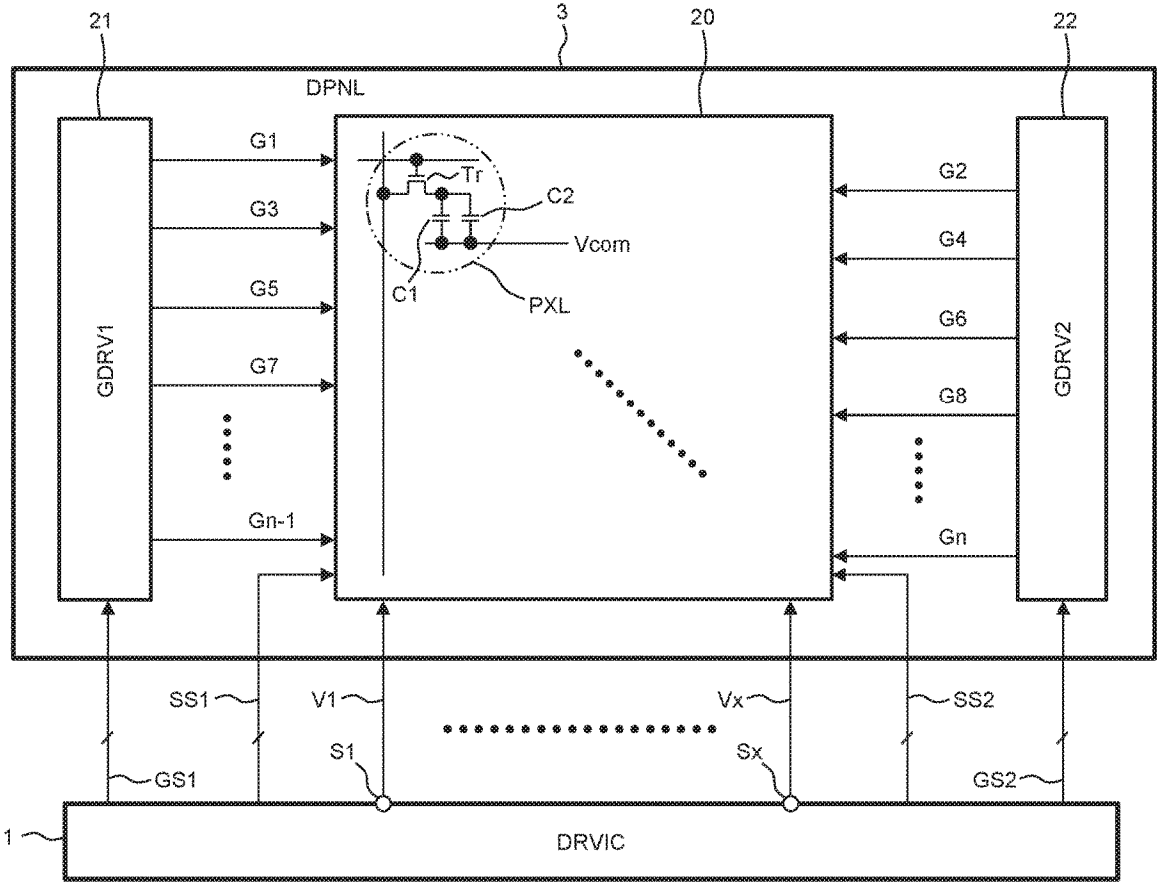
FIG. 2A is a block diagram illustrating one example of a display panel.

The display control device, denoted by numeral 1, is mounted on a glass substrate of a display panel (DPNL) 3, such as a liquid crystal display panel, to form a display panel module MDL. The display panel module MDL is mounted on an electronic appliance such as a tablet terminal and a smartphone. The display control device 1 is connected to a host device 2 configured to execute application programs, such as an application processor. The display control device 1 receives image data and display commands from the host device 2 and drives the display panel 3 to display images on the display panel 3 in response to the received image data and display commands. As illustrated in FIG. 2 for example, the display panel 3 includes a display area 20 and gate drivers 21 and 22. A plurality of display elements (subpixels) PXL (one illustrated in the figure) are arrayed in the display area 20 in a plurality of rows extending in the X direction and in a plurality of columns extending in the Y direction. The display elements PXL each include a liquid crystal display element in which a selection transistor Tr and parallel-connected capacitor elements C1 and C2 are connected in series. The selection terminals (or the gates) of the selection transistors Tr of the display elements PXL in each row of the display elements PXL are connected to the corresponding one of the gate lines G1 to Gn, where n is an even number. The data input terminals of the selection transistors Tr of the display elements PXL in each column of the display elements are connected to the corresponding one of the source lines S1_R to Sx_B, where x is an integer equal to or more than two. The reference terminals of the parallel-connected capacitor elements C1 and C2 of the display elements PXL are set to the common level Vcom. The parallel-connected capacitor elements C1 and C2 include the liquid crystal capacitor C1 and a charge holding capacitor C2. Each display element PXL functions as a subpixel and each color pixel includes three subpixels which display red (R), green (G) and blue (B), respectively. The source lines S1_R to Sx_B are respectively associated with the columns of the subpixels. The suffixes "R", "G" and "B" attached to the reference numerals denoting the source lines indicate the corresponding subpixel types (or colors).

In the example illustrated in FIG. 2, to achieve interlace driving, one of the gate drivers 21 and 22, which is hereinafter referred to as odd gate driver (GDRV1) 21, drives odd-numbered gate lines G1, G3, . . . Gn-1, and the other of the gate drivers 21 and 22, which is hereinafter referred to as even gate driver (GDRV2) 23, drives even-numbered gate lines G2, G4, . . . Gn. The odd gate driver 21 and the even gate driver 22 are located separately across the display area 20; the odd gate driver 21 is located on the left of the display area 20 and the even gate driver 22 is located on the right. This arrangement effectively avoids the spaces accommodating the gate drivers being biased to the left or right.

Figure 2B:
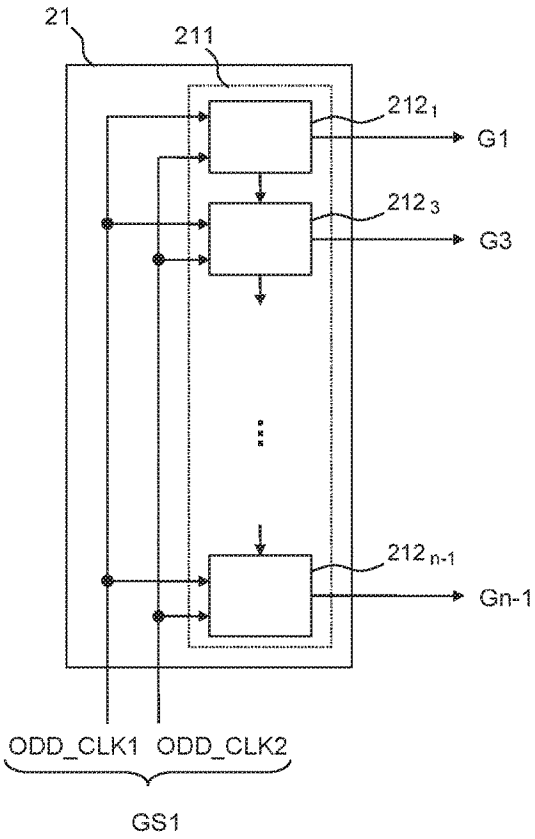
FIG. 2B is a block diagram illustrating one example of an odd gate driver.

FIG. 2B is a block diagram schematically illustrating an exemplary configuration of the odd gate driver 21. The odd gate driver 21 includes a shift register 211 including serially-connected stages $\mathbf{212}_1$, $\mathbf{212}_3$ . . . and $\mathbf{212}_1$ each including a master-slave latch. The stages $\mathbf{212}_1$, $\mathbf{212}_3$ . . . and $\mathbf{212}_1$ are connected to the gate lines G1, G3 . . . and Gn-1, respectively. The odd gate driver 21 are configured to sequentially select the gate lines G1, G3 . . . and Gn-1 by sequentially shifting a shift data from the first stage $\mathbf{212}_1$ to the final stage $\mathbf{212}_{n-1}$ with two-phase shift clocks (ODD_CLK1, ODD_CLK2) in synchronization with display timing.

Figure 2C:
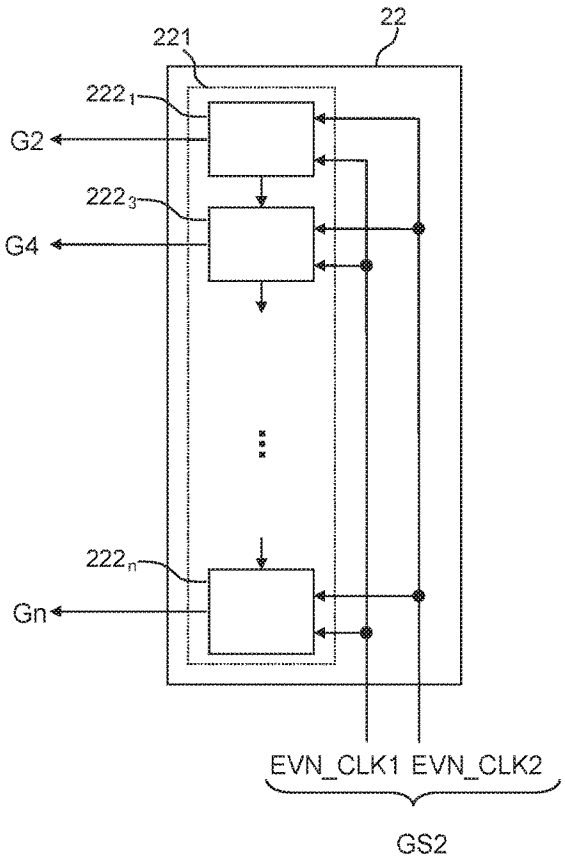
FIG. 2C is a block diagram illustrating one example of an even gate driver.

FIG. 2C is a block diagram schematically illustrating an exemplary configuration of the even gate driver 22. Similarly to the odd gate driver 21, the even gate driver 22 includes a shift register 221 including serially-connected stages $\mathbf{222}_2$ $\mathbf{222}_4$ . . . and $\mathbf{222}_n$ each including a master-slave latch.

The stages $\mathbf{222}_1$, $\mathbf{222}_3$ . . . and $\mathbf{222}_{n-1}$ are connected to the gate lines G2, G4 . . . and Gn, respectively. The even gate driver 22 are configured to sequentially select the gate lines G2, G4 . . . and Gn by sequentially shifting a shift data from the first stage $\mathbf{222}_2$ to the final stage $\mathbf{222}_n$ with two-phase shift clocks (EVN_CLK1, EVN_CLK2) in synchronization with display timing.

The phases of the shift clocks supplied to the odd gate driver 21 are shifted from those of the shift clocks supplied to the even gate driver 22 by 180 degrees to thereby avoid odd-numbered and even-numbered gate lines being selected at the same time. It should be noted that the rows of the display elements arrayed along the respective gate lines may be referred to as display lines, hereinafter.

As is exemplarily illustrated in FIG. 1, the display control device 1 includes a system interface circuit (SYSIF) 4, a register circuit (REGC) 5, a control circuitry (TMGG) 6, an FIFO (first-in first-out) buffer memory (BUFMRY) 7, a grayscale voltage generator circuit (GLYSCL) 8, a source driver (SRCDRV) 9, a gate line controller 10, an oscillator circuit (OSC) 11 which generates an internal clock signal and a power supply circuit 12.

The system interface circuit 4 receives display commands and other control data from the host device 2, and outputs responses and status information to be sent to the host device 2. Additionally, the system interface circuit 4 receives image data from the host device 2 in accordance with a predetermined bus interface specification or high-speed serial interface specification.

The system interface circuit 4 operates on an externally-supplied power supply voltage. The power supply circuit 12 generates an internal power supply voltage to be supplied to digital circuits from an externally-supplied logic power supply voltage and generates analog power supply voltages from externally-supplied analog power supply voltages. The grayscale voltage generator circuit 8, the source driver 9 and the gate line controller 10 operate on the internal analog power supply voltages. The internal logic power supply voltage is supplied to various logic circuits, including the control circuitry 6.

The control circuitry 6 controls the system interface circuit 4 and the buffer memory 7 to temporarily store the image data supplied from the host device 2 in the buffer memory 7. The image data stored in the buffer memory 7 or image data supplied as an image data stream from the host device 2 are latched by a line latch circuit 43 (see FIG. 5) of the source driver 9 in units of display lines. The line latch circuit 43 time-divisionally latches input data P1 to Px in units of subpixel types for each gate line, although not limited to this. For each gate line, input data P1 to Px associated with subpixels of red are first latched, input data P1 to Px associated with subpixels of green are then latched, and input data P1 to Px associated with subpixels of blue are finally latched. The input data P1 to Px include image data corresponding to x subpixels, which may describe a grayscale value with N bits (for example, eight bits) for each subpixel, although not limited to this.

The grayscale voltage generator circuit 8 generates gamma-corrected grayscale voltages, for example, 256-level grayscale voltages VP0 to VP255.

Figure 5:
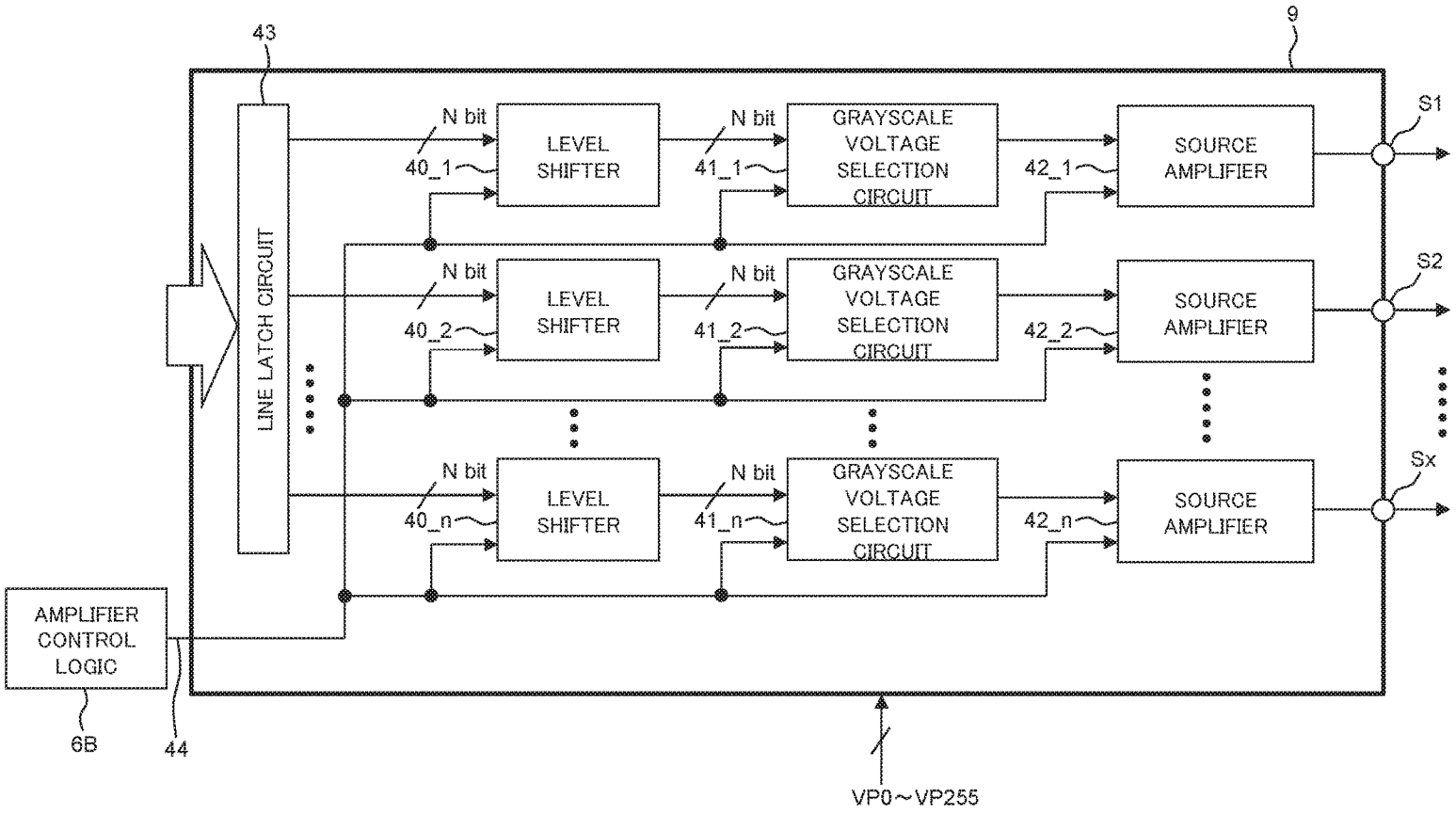
FIG. 5 is a block diagram illustrating one example of a source driver integrated in the display control device.

The source driver 9 generates the drive signals V1 to Vx by selecting the grayscale voltages VP0 to VP255 in response to the grayscale values of the respective subpixels described in the input data P1 to Px in units of subpixel types. The drive signals V1 to Vx are each generated as a voltage signal. As illustrated in FIG. 5, the source driver 9 is configured to provide a level shift from the logic voltage level to the analog voltage level for the data P1 to Px latched by the line latch circuit 43 by using N-bit level shifters 40_1 to 40_x, select the grayscale voltages corresponding to the level-shifted data by using grayscale voltage selector circuits 41_1 to 41_x, and output the selected grayscales as the drive signals V1 to Vx by using source amplifiers 42_1 to 42_x, which are each configured as a buffer amplifier, from drive terminals S1 to Sx. The level shifters 40_1 to 40_x, the grayscale voltage selector circuits 41_1 to 41_x and the source amplifiers 42_1 to 42_x operate on an analog power supply voltage (e.g., 12V) higher than the logic power supply voltage (e.g., 3.3V) and the start and halt of the supply of the analog power supply voltage to these circuits is controllable in response to an analog power supply control signal 44. The analog power supply control signal 44 is generated by amplifier control logic 6B in the control circuitry 6.

The drive voltages V1 to Vx are supplied to the display panel 3 from the drive terminals S1 to Sx. When the input data P1 to Px are image data describing the grayscale value of each subpixel with eight bits and the number of the subpixels of each display line is 1536 (=512×3), the input data P1 and Px are defined as 512-byte data. The 512-byte input data P1 to Px are time-divisionally for each of the subpixel types "R", "G" and "B". In total, 1536-byte data are supplied in driving the subpixels of each display line.

Figure 4:
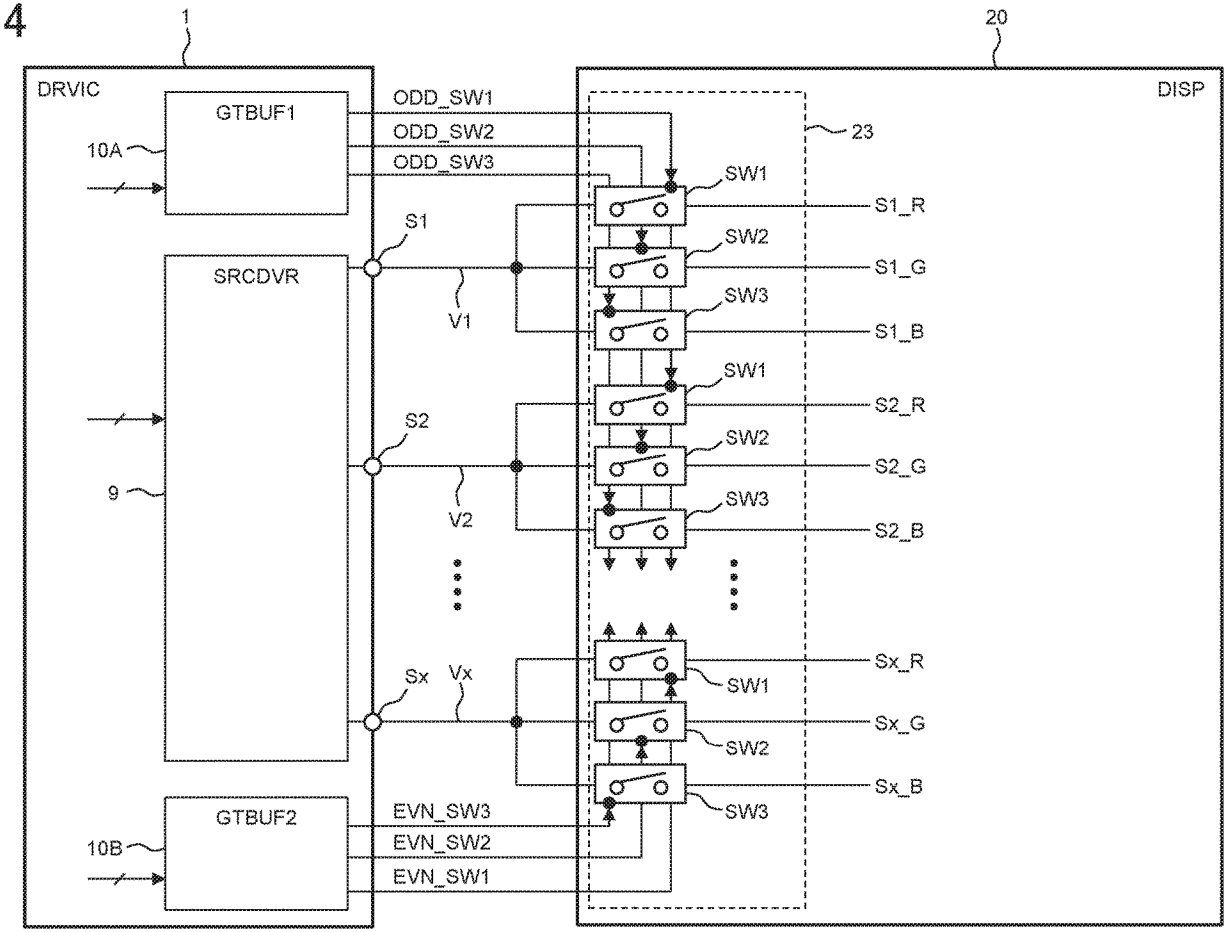
FIG. 4 is a block diagram illustrating one example of a switch circuit integrated in the display panel.

As illustrated in FIG. 4, the drive signals V1 to Vx output from the drive terminals S1 to Sx are supplied to a source line switch circuit 23. The source line switch circuit 23 distributes the drive signals V1 to Vx, which are time-divisionally supplied for the respective subpixel types "R", "G" and "B", to the source lines S1_R, S1_G, S1_B to Sx_R, Sx_G, Sx_B, in units of subpixel types. The source switch circuit 23 includes three source line switches SW1, SW2 and SW3 for each of the drive signals V1 to Vx, and is configured to distribute the drive signals V1 to Vx associated with "R", "G" and "B" , which are time-divisionally supplied thereto, to the source lines associated with "R", "G" and "B", respectively. The source line switches SW1 are controlled on the wired OR or logical OR of the output synchronization signals ODD_SW1 and EVN_SW1, the source line switches SW2 are controlled on the wired OR or logical OR of the output synchronization signals ODD_SW2 and EVN_SW2, and the source line switches SW3 are controlled on the wired OR or logical OR of the output synchronization signals ODD_SW3 and EVN_SW3.

Figure 3:
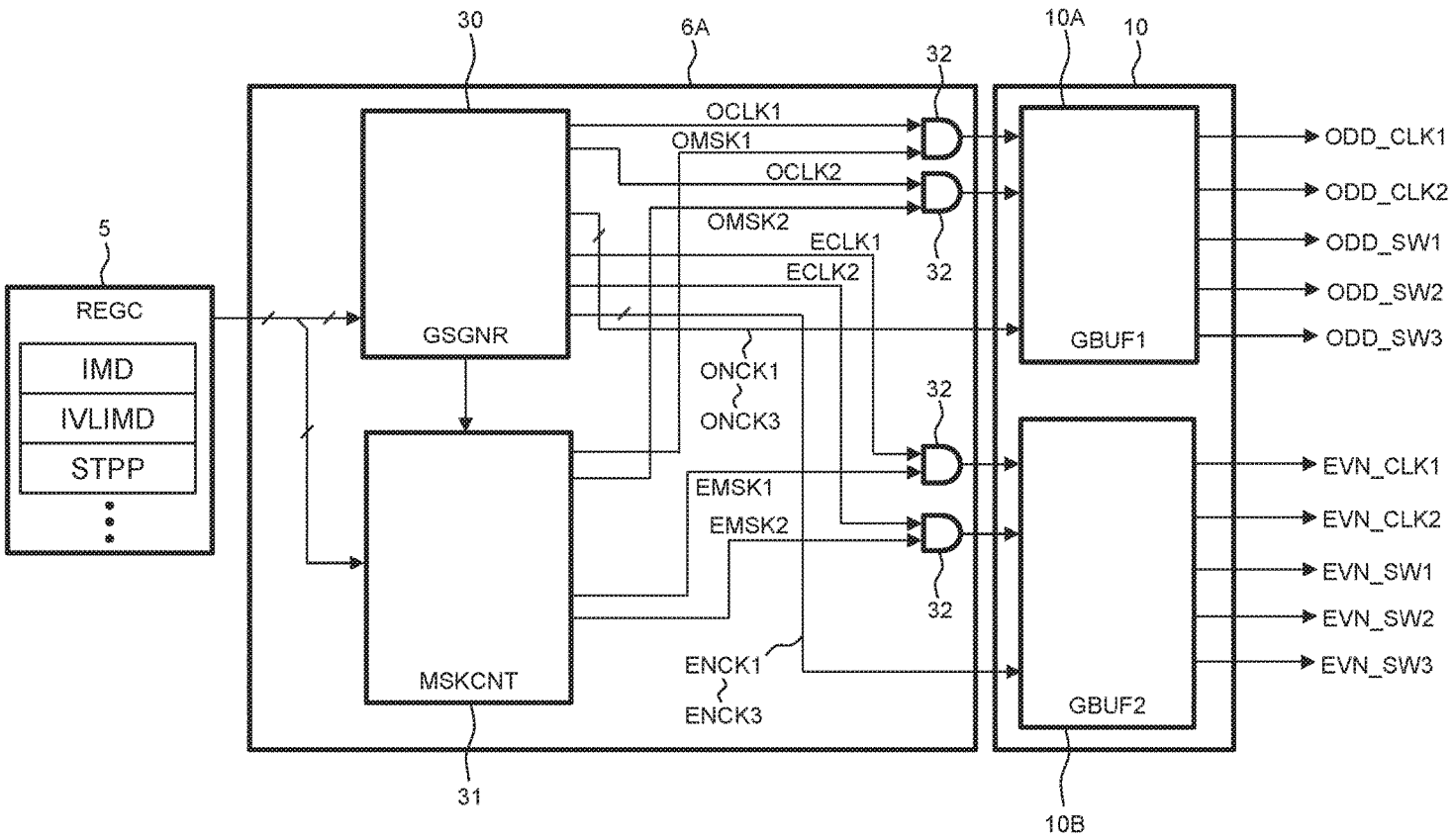
FIG. 3 is a block diagram illustrating generation logic of gate line control signals and output synchronization signals in the display control device.

As illustrated in FIGS. 1 and 2, the gate line controller 10 separately generates odd-numbered gate line control signals GS1 and even-numbered gate line control signals GS2, and supplies the generated odd-numbered gate line control signals GS1 and even-numbered gate line control signals GS2 to the gate drivers 21 and 22, respectively. In this embodiment, the odd-numbered gate line control signals GS1 are generated as two-phase shift clocks used to select the odd-numbered gate lines G1, G3 . . . and Gn-1 of the display panel 3, and therefore the odd-numbered gate line control signals GS1 may be also denoted by legends "ODD_CLK1" and "ODD_CLK2". Similarly, the even-numbered gate line control signals GS2 include two-phase shift clocks used to select the even-numbered gate lines G2, G4 . . . and Gn, and therefore the even-numbered gate line control signals GS2 may be also denoted by legends "EVN_CLK1" and "EVN_CKL2." The phases of the odd-numbered gate line control signals ODD_CLK1 and ODD_CLK2, which are generated as shift clocks supplied to the odd gate driver 21, and are different by 180 degrees from the phases of the even-numbered gate line control signals EVN_CLK1 and EVN_CLK2, which are generated as shift clocks supplied to the even gate driver 22. This effectively avoids the odd-numbered gate lines being selected at the same time as the even-numbered gate lines. In other words, the odd-numbered gate line control signals ODD_CLK1 and ODD_CLK2 and the even-numbered gate line control signals EVN_CLK1 and EVN_CLK2 are sequentially activated alternately. As illustrated in FIG. 3, the odd-numbered gate line control signals ODD_CLK1 and ODD_CKL2 are output from a gate buffer (GBUF1) 10A and the even-numbered gate line control signals EVN_CLK1 and EVN_CKL2 are output from a gate buffer (GBUF2) 10B.

The gate line controller 10 also generates the output synchronization signals ODD_SW1 to ODD_SW3 (SS1) and EVN_SW1 to EVN_SW3 (SS2) and supplies the same to the switch circuit 23. The output synchronization signals ODD_SW1 to ODD_SW3 and EVN_SW1 to EVN_SW3 are generated so that the turn-on periods of the source lines switches SW1, SW2 and SW3 do not overlap one another and this avoids the same drive signal being supplied to source lines associated with different subpixels. In other words, the output synchronization signals ODD_SW1 to ODD_SW3, and EVN_SW1 to EVN_SW3, which are used as switch control signals, respectively indicate output periods during which drive signals associated with subpixels associated with a gate line are time-divisionally output from the drive terminals S1 to Sx for each of the subpixel types "R", "G" and "B". As illustrated in FIG. 4, the output synchronization signals ODD_SW1 to ODD_SW3 are output from a gate buffer 10A and the output synchronization signals EVN_SW1 to EVN_SW3 are output from a gate buffer 10B.

The control circuitry 6 interprets commands received from the host device 2 and performs an internal operation control of the entire of the display control device 1 with reference to control data stored in the register circuit 5, to display images on the display panel 3.

In this embodiment, operation modes of the display control device include a non-interlace mode, an interlace mode and an interval interlace mode.

When the non-interlace mode is specified, the control circuitry 6 performs a control to sequentially activate the odd-numbered gate line control signals GS1 and even-numbered gate line control signals GS2 alternately.

Figure 6:
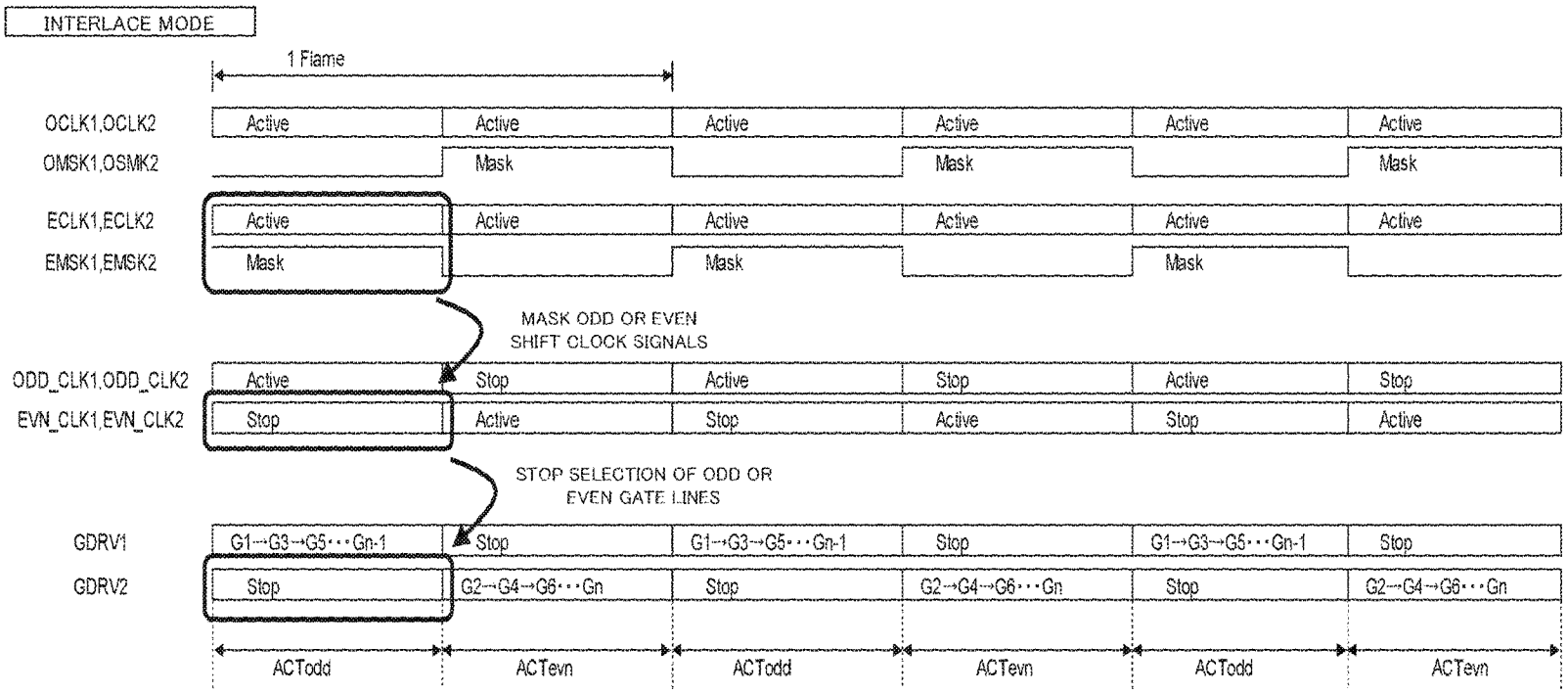
FIG. 6 is a timing chart illustrating an exemplary operation in an interlace mode.

When the interlace mode is specified, the control circuitry 6 performs a control to alternately provide odd field periods ACTodd and even field periods ACTevn as illustrated in FIG. 6. In the odd field periods, the odd-numbered gate line control signals ODD_CLK1 and ODD_CLK2 are sequentially activated and the even-numbered gate line control signals EVN_CLK1 and EVN_CLK2 are deactivated. In the even field periods, the even-numbered gate line control signals EVN_CLK1 and EVN_CLK2 are sequentially activated and the odd-numbered gate line control signals ODD_CLK1 and ODD_CLK2 are deactivated.

Figure 7:
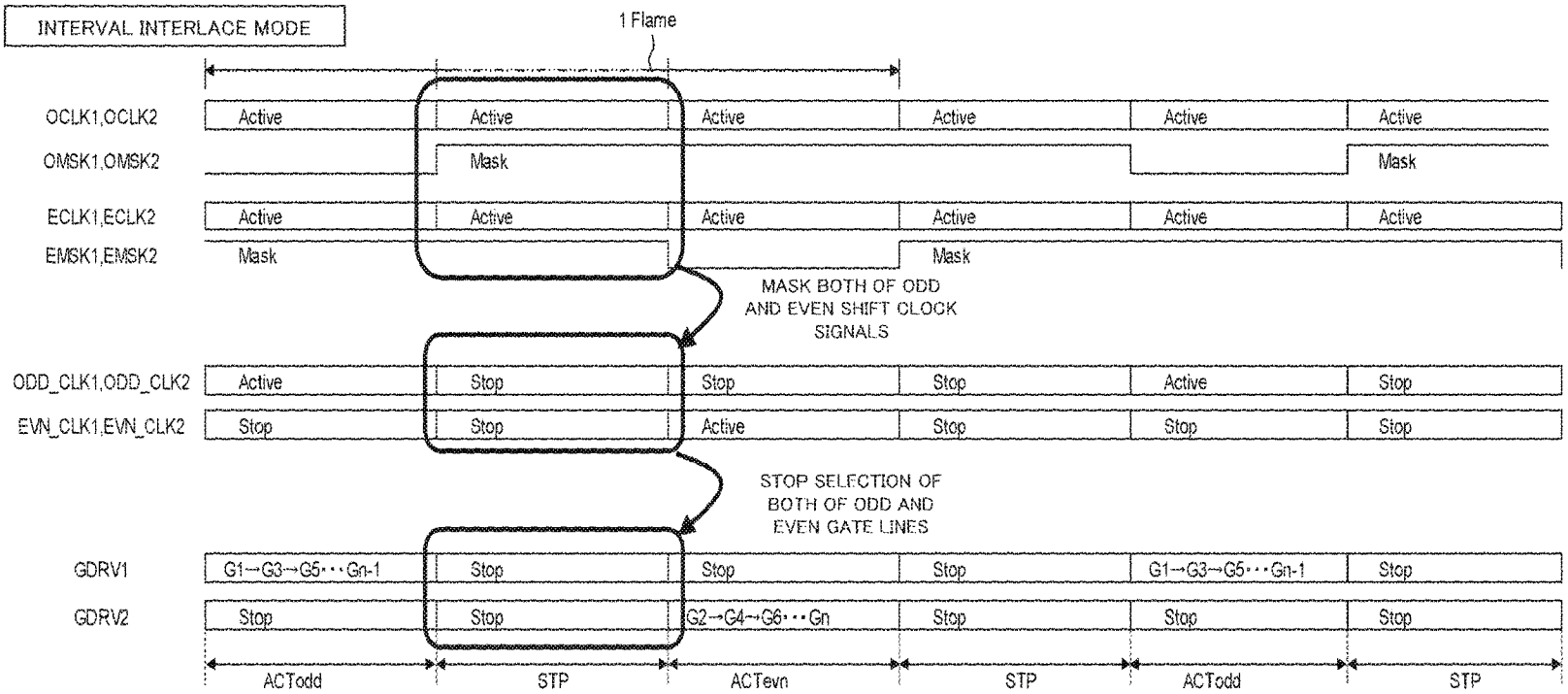
FIG. 7 is a timing chart illustrating an exemplary operation in an interval interlace mode.
Figure 8:
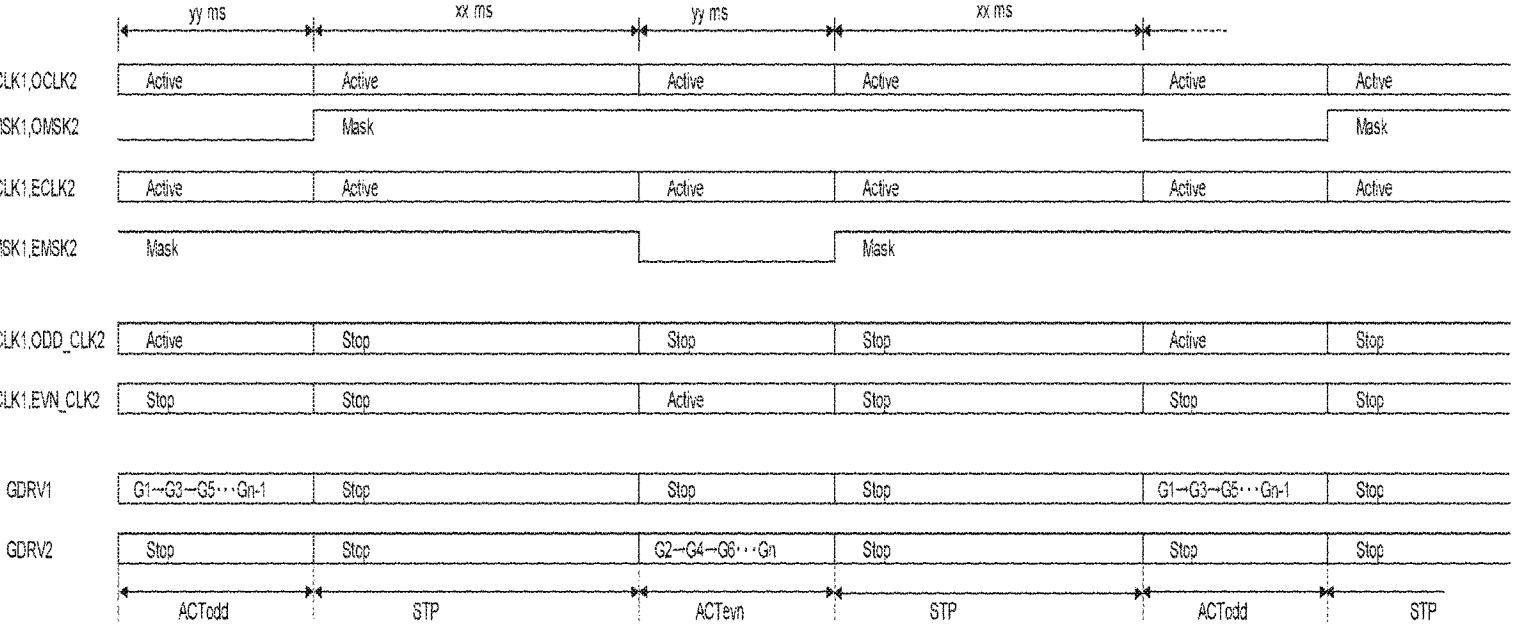
FIG. 8 is a timing chart illustrating an exemplary operation in the interval interlace mode for the case when a gate halt period is set longer than that in the operation illustrated in FIG. 7.

When the interval interlace mode is specified, as illustrated in FIGS. 7 and 8, the control circuitry 6 performs a control to provide a gate halt period STP between every adjacent two of the odd fields periods ACTodd and the even field periods ACTevn, which are alternately provided. In the gate halt period STP, both of the odd-numbered gate line control signals ODD_CLK1 and ODD_CLK2 and even-numbered gate line control signals EVN_CLK1 and EVN_CLK2 are deactivated.

FIG. 3 illustrates control logic 6A for generating, in response to selection of the above-described operation modes, the odd-numbered gate line control signals ODD_CLK1, ODD_CLK2, the even-numbered gate line control signals EVN_CLK1, EVN_CKL2, the output synchronization signals ODD_SW1 to ODD_SW3, which are sequentially activated in response to the selection of the odd-numbered gate lines, and the output synchronization signals EVN_SW1 to EVN_SW3, which are sequentially activated in response to the selection of the even-numbered gate lines.

The control logic 6A, which is incorporated in the control circuitry 6, includes signal generation logic 30, mask control logic 31 and a plurality of AND gates 32. The register circuit 5 has setting regions in which an interlace mode data IMD, interval interlace mode data IVLIMD, halt period data STPP, horizontal synchronization period data and vertical synchronization period data are respectively stored. Upon a system reset, initial values are loaded to these setting regions from a non-volatile memory (not illustrated). The data stored in the setting regions may be rewritable from the host device 2. The register circuit 5 may be configured so that the data stored in the setting regions may be set to desired values in response to a pull-up or pull-down of a control signal.

The signal generation logic 30 and the mask control logic 31 receives the setting data stored in the register circuit 5 and generates shift clocks OCLK1, OCLK2 and mask signals OMSK1 and OMSK2, which are used for generating the odd-numbered gate line controls signals ODD_CLK1 and ODD_CLK2 and shift clocks ECLK1, ECLK2 and mask signals EMSK1 and EMSK2, which are used for generating the even-numbered gate line controls signals EVN_CLK1 and EVN_CLK2, in synchronization with an internal operation reference clock (not illustrated). The signal generation logic 30 also generates non-overlapping three phase clocks ONCK1 to ONCK3, which are used for generating the output synchronization signals ODD_SW1 to ODD_SW3, and non-overlapping three phase clocks ENCK1 to ENCK3, which are used for generating the output synchronization signals EVN_SW1 to EVN_SW3.

The clock signal OCLK1 passes through the corresponding AND gate 32 and is output from the gate buffer 10A as the odd-numbered gate line control signals ODD_CLK1 when the mask signal OMSK1 is deactivated, and the clock signal OCLK2 passes through the corresponding AND gate 32 and is output from the gate buffer 10A as the odd-numbered gate line control signals ODD_CLK2 when the mask signal OMSK2 is deactivated. Similarly, the clock signal ECLK1 passes through the corresponding AND gate 32 and is output from the gate buffer 10B as the even-numbered gate line control signals EVN_CLK1 when the mask signal EMSK1 is deactivated, and the clock signal ECLK2 passes through the corresponding AND gate 32 and is output from the gate buffer 10B as the even-numbered gate line control signals EVN_CLK2 when the mask signal EMSK2 is deactivated.

Figure 9:
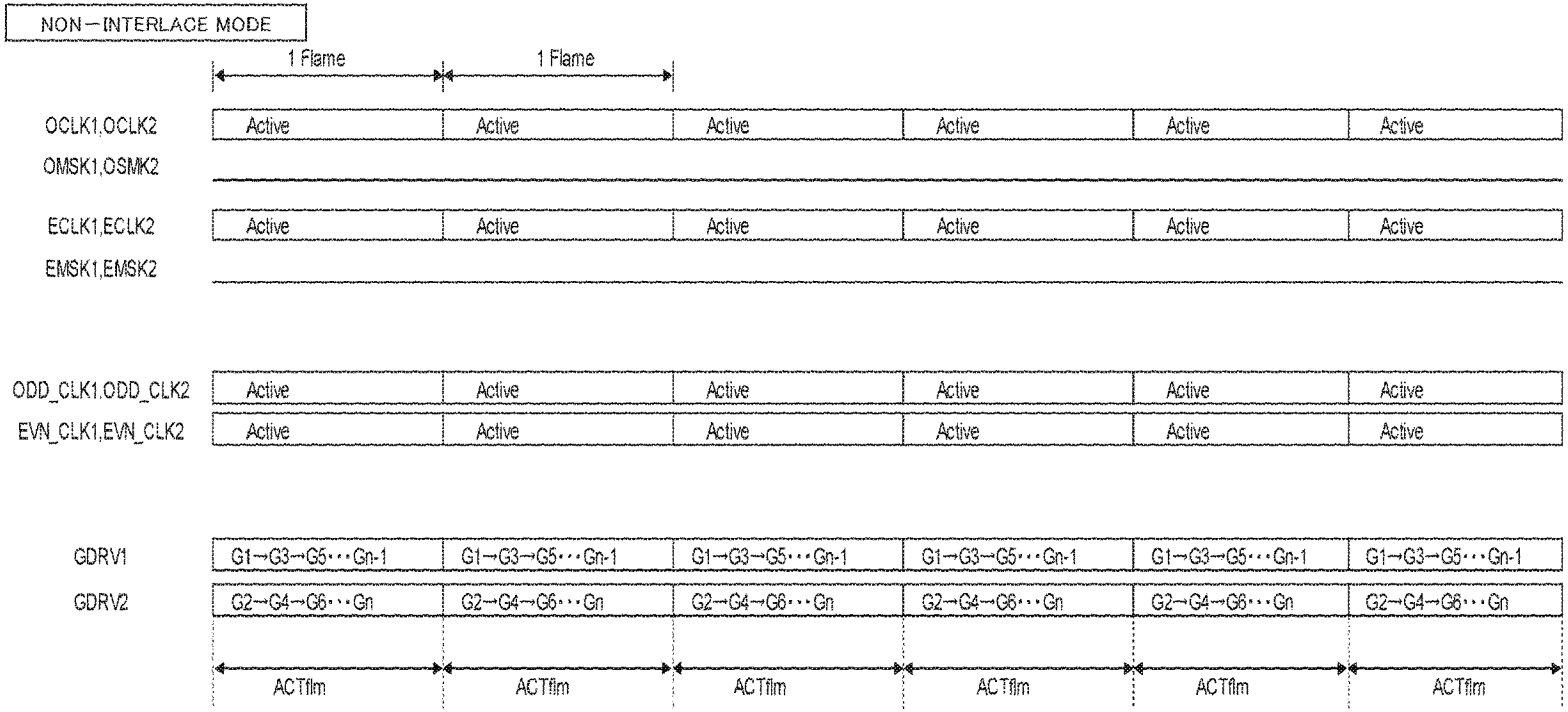
FIG. 9 is a timing chart illustrating an exemplary operation in a non-interlace mode.

When the non-interlace mode is specified, as illustrated in FIG. 9, the shift clocks OCLK1, OCLK2, ECLK1 and ECLK2 are activated and validated as clocks signals with the phases of the shift clocks OCLK1 and OCLK2 shifted by 180 degrees from those of the shift clocks ECLK1 and ECLK2, respectively, and the mask signals OMSK1, OMSK2, EMSK1 and EMSK2 are all deactivated. As a result, the gate drivers 21 and 22 sequentially select gate lines alternately in each frame period ACTflm in response to the shift clocks OCLK1, OCLK2, ECLK1 and ECLK, which are validated as clock signals with the phases of the shift clocks OCLK1 and OCLK2 are shifted by 180 degrees from those of the shift clocks ECLK1 and ECLK2. That is, in each frame period ACTflm, the gate driver 21 (GDRV1) sequentially selects the odd-numbered gate lines G1, G3, . . . Gn-1 in this order and the gate driver 22 (GDRV2) sequentially selects the even-numbered gate lines G2, G4, . . . Gn in this order. As a whole, the gate lines G1, G2, G3, . . . Gn are selected by the gate drivers 21 and 22 in this order (that is, in order of position), in each frame period ACTflm. The source driver 9 outputs drive signals associated with image data of one frame to the source lines S1_R to Sx_R in synchronization with the selection timing of the gate lines in each frame period ACTflm.

When the interlace mode is specified, as illustrated in FIG. 6, the shift clocks OCLK1, OCLK2, ECLK1 and ECLK2 are activated with the phases of the shift clocks OCLK1 and OCLK2 shifted by 180 degrees from those of the shift clocks ECLK1 and ECLK2. Meanwhile, the mask signals OMSK1 and OMSK2 are deactivated in the odd field periods ACTodd, and activated to mask the shift clocks OCLK1 and OCLK2 in the even field periods ACTevn. The mask signals EMSK1 and EMSK2 are deactivated in the even field periods ACTevn, and activated to mask the shift clocks ECLK1 and ECLK2 in the odd field periods ACTodd. As a result, in odd field periods ACTodd, the odd-numbered gate line control signals ODD_CLK1 and ODD_CLK2 are validated as clock signals and the switching of the signal levels of the even-numbered gate line control signals EVN_CLK1 and EVN_CLK2 is halted. Accordingly, in the odd field periods ACTodd, the gate driver 21 (GDRV1) selects the odd-numbered gate lines G1, G3 . . . and Gn-1 in this order, and the gate driver 22 (GDRV2) selects none of the even-numbered gate lines G2, G4 . . . and Gn. In even field periods ACTevn, the even-numbered gate line control signals EVN_CLK1 and EVN_CLK2 are validated as clock signals and the switching of the signal levels of the odd-numbered gate line control signals ODD_CLK1 and ODD_CLK2 is halted. Accordingly, in the even field periods ACTevn, the gate driver 22 (GDRV2) selects the even-numbered gate lines G2, G4 . . . and Gn in this order, and the gate driver 21 (GDRV1) selects none of the odd-numbered gate lines G1, G3 . . . and Gn-1. In each odd field period ACTodd, the source driver 9 outputs the drive signals associated with image data of the odd field period of the frame to the source lines S1_R to Sx_B in synchronization with the selection timing of the gate lines. In each even field period ACTevn, the source driver 9 outputs the drive signals associated with image data of the even field period of the frame to the source lines S1_R to Sx_B in synchronization with the selection timing of the gate lines.

When the interval interlace mode is specified, as exemplarily illustrated in FIG. 7, a gate halt period STP in which both of the odd-numbered gate line control signals ODD_CLK1, ODD_CLK2 and the even-numbered gate line control signals EVN_CLK1 and EVN_CLK2 are deactivated is inserted between every adjacent two of the odd field periods ACTodd and the even field periods ACTevn, differently from the case of the interlace mode. In other words, a period in which all of the mask signals OMSK1, OMSK2, EMSK1 and EMSK2 are activated is inserted after each of the odd field periods ACTodd and the display drive operation is temporality stopped by stopping the switching of the signal levels of both of the odd-numbered gate line control signals ODD_CLK1, ODD_CLK2 and the even-numbered gate line control signals EVN_CLK1 and EVN_CLK2. The length of duration of the gate halt periods STP are controlled by the mask control logic 31 in accordance with the gate halt period data STPP set to the register circuit 5. In the gate halt periods STP, the amplifier control logic 6B stops supplying the power supply voltage to the level shifters 40_1 to 40_n, the grayscale voltage selector circuits 41_1 to 41_n and the source amplifiers 42_1 to 42_n, which are not required to operate in the gate halt periods STP.

In the interval interlace mode, all of the odd-numbered gate line control signals ODD_CLK1, ODD_CLK2 and the even-numbered gate line control signals EVN_CKL1 and EVN_CLK2 are deactivated in the gate halt periods STP, each provided between adjacent two of the odd field periods ACTodd and the even field periods ACTevn. This allows effectively reducing the power consumption per unit time of the display control device 1. Furthermore, the amplifier control logic 6B stops supplying the power supply voltage to the source amplifiers 42_1 to 42_N and other circuits of the source driver 9 in the gate halt period STP and this allows further reducing the power consumption.

In the interval interlace mode, the length of the duration of the gate halt period STP is programmably set with the gate halt period data STPP stored in the register circuit 5. As exemplarily illustrated in FIG. 8, the time duration xx ms of the gate halt period STP is variable. Similarly, the durations of the odd field periods ACTodd and the even field periods ACTevn are variable in response to the vertical synchronization period data stored in the register circuit 5. As exemplarily illustrated in FIG. 8, the time duration yy ms of the odd field periods ACTodd and the even field periods ACTevn are variable.

The signal generation logic 30 sequentially enables the non-overlapping three-phase clocks ONCK1 to ONCK3 used in the odd field periods to the high level in a predetermined order in each horizontal period, to indicate switch-on periods. In response to the operation mode being set to interlace mode or interval interlace mode, the signal generation logic 30 inserts wait periods each having the time duration of one horizontal synchronization period, in which the signal levels of the non-overlapping three-phase clocks ONCK1 to ONCK3 remain unchanged. Similarly, the signal generation logic 30 sequentially enables the non-overlapping three-phase clocks ENCK1 to ENCK3 used in the even field periods to the high level in a predetermined order in each horizontal period, to indicate switch-on periods. First, in response to the operation mode being set to interlace mode or interval interlace mode, the signal generation logic 30 inserts wait periods each having the time duration of one horizontal synchronization period, in which the signal levels of the non-overlapping three-phase clocks ENCK1 to ENCK3 remain unchanged. In this embodiment, the non-overlapping three-phase clocks ENCK1 to ENCK3 are in phase with the non-overlapping three-phase clocks ONCK1 to ONCK3, respectively. The non-overlapping three-phase clocks ONCK1 to ONCK3 with the waveforms thus controlled are output as the output synchronization signals ODD_SW1 to ODD_SW3 from the gate buffer 10A, and the non-overlapping three-phase clocks ENCK1 to ENCK3 with the waveforms controlled similarly are output as the output synchronization signals EVN_SW1 to EVN_SW3 from the gate buffer 10B.

Figure 10:
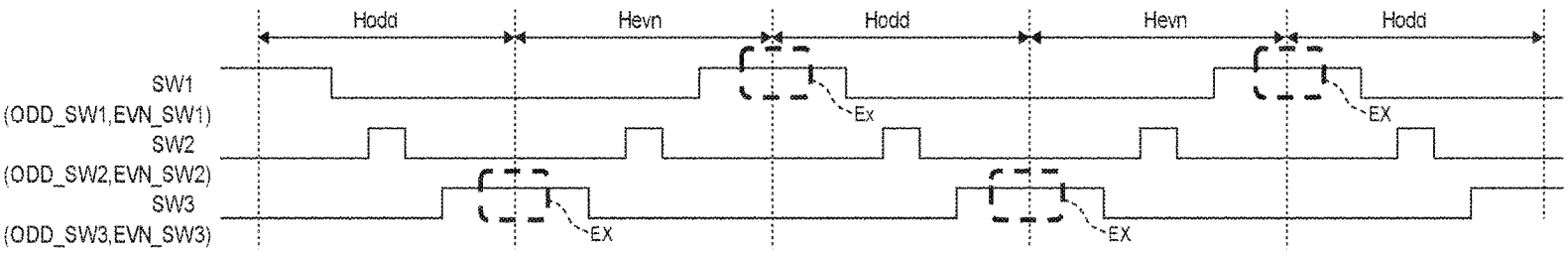
FIG. 10 is a timing chart illustrating exemplary waveforms of switch control signals supplied to a switch circuit which distributes drive signals to corresponding source lines in the non-interlace mode, the drive signals being time-divisionally supplied to the display panel.
Figure 13:
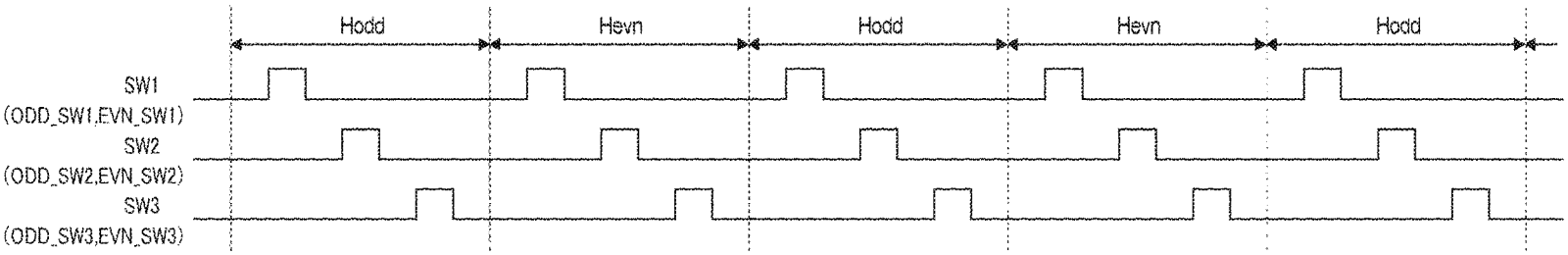
FIG. 13 is a timing chart illustrating a comparative example in which no attention is paid to reduce the number of switching of the switch circuit in connection with the operation illustrated in FIG. 10.

When the non-interlace mode is specified, the output synchronization signals ODD_SW1 to ODD_SW3 and EVN_SW1 to EVN_SW3 are generated with the clock waveforms illustrated in FIG. 10. The legends "Hodd" denote horizontal synchronization periods associated with the odd-numbered gate lines and the legends "Hevn" denote horizontal synchronization periods associated with the even-numbered gate lines. It should be noted that the waveform of the output ODD_SW1 to ODD_SW3 and EVN_SW1 to EVN_SW3 are controlled so that the output synchronization signals which have been last enabled in each display period associated with each gate line (Hodd, Hevn) are first enabled in the next display period associated with the next gate line, so that the output synchronization signal which has been last enabled in the display period associated with each gate line remains enabled until the beginning of the display period associated with the next gate line. It should be noted that the legends "EX" in FIG. 10 indicate the timing at which the relevant output synchronization signals remain enabled. If not designed so, the output synchronization signals may be generated with the waveforms illustrated in FIG. 13. The operation illustrated in FIG. 10 effectively reduces the number of switching of the source line switches SW1, SW2 and SW3 which distribute the drive signals associated with the respective subpixels to the corresponding source lines, compared with that illustrated in FIG. 13. In other words, the number of charging and discharging of the signal lines transmitting the switch control signals of the source line switches SW1, SW2 and SW3 are effectively reduced by continuously enabling the output synchronization signal which have been last enabled in the display period associated with each gate line in the display period associated with the next gate line. The operation illustrated in FIG. 10 reduces the power consumption in the gate line controller 10 in this aspect.

Figure 11:
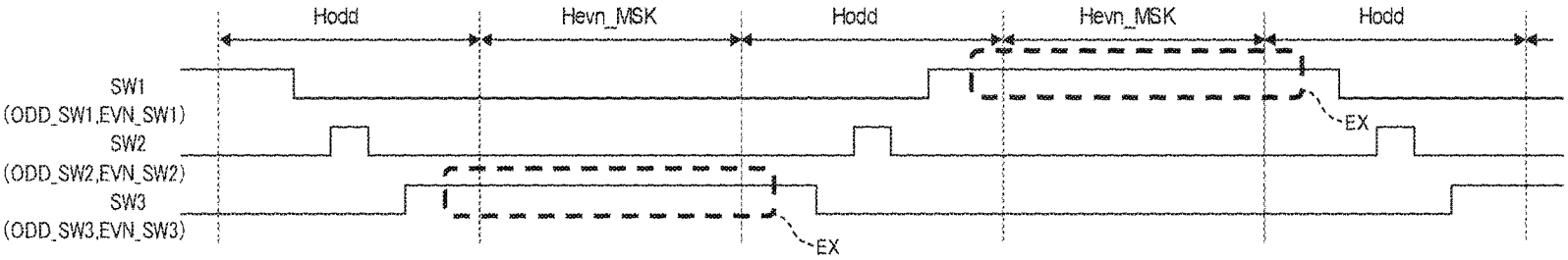
FIG. 11 is a timing chart illustrating exemplary waveforms of the switch control signals supplied to the switch circuit which distributes the drive signals time-divisionally supplied to the display panel in odd-numbered fields in the interlace mode or the interval interlace mode.
Figure 12:
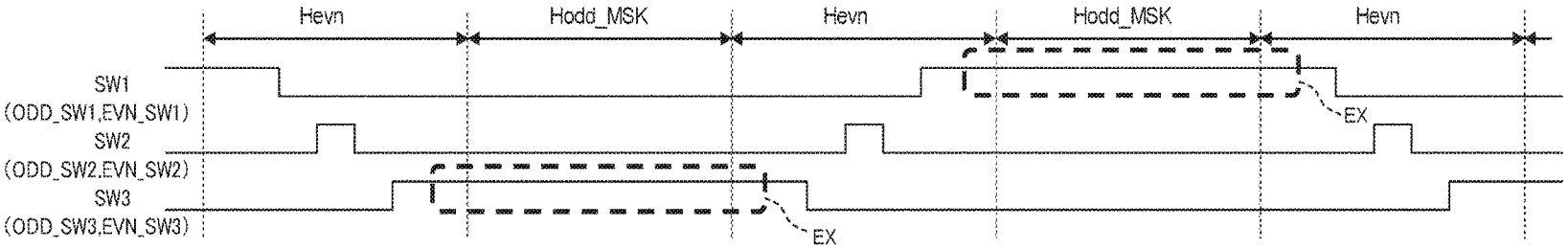
FIG. 12 is a timing chart illustrating exemplary waveforms of the switch control signals supplied to the switch circuit which distributes the drive signals time-divisionally supplied to the display panel in even-numbered fields in the interlace mode or the interval interlace mode.
Figure 14:
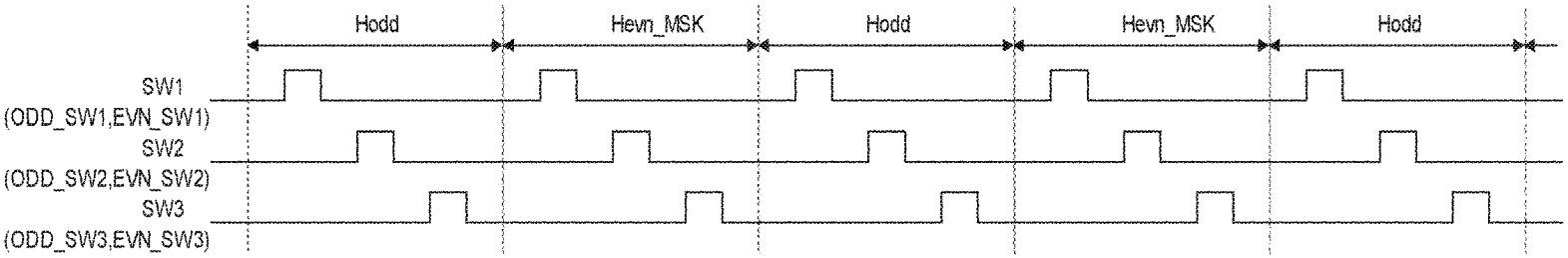
FIG. 14 is a timing chart illustrating a comparative example in which no attention is paid to reduce the number of switching of the switch circuit in connection with the operation illustrated in FIG. 12.

When the interlace mode or the interval interlace mode is specified, the output synchronization signals ODD_SW1 to ODD_SW3 and EVN_SW1 to EVN_SW3 are generated with the clock waveforms illustrated in FIGS. 11 and 12. In FIG. 11, which illustrates the operation in the odd field periods, the legends "Hodd" denote horizontal synchronization periods associated with the odd-numbered gate lines and the legends "Hevn_MSK" denote non-display periods associated with the even-numbered gate lines, in which the signal levels of the output synchronization signals ODD_SW1 to ODD_SW3 and EVN_SW1 to EVN_SW3 are held unchanged. In FIG. 12, which illustrates the operation in the even field periods, the legends "Hevn" denote horizontal synchronization periods associated with the even-numbered gate lines and the legends "Hodd_MSK" denote non-display periods associated with the odd-numbered gate lines, in which the signal levels of the output synchronization signals ODD_SW1 to ODD_SW3 and EVN_SW1 to EVN_SW3 are held unchanged. In the hold periods Hevn_MSK, as illustrated in FIG. 11, the output synchronization signals which have been last enabled in the display period Hodd associated with each of the odd-numbered gate line are continuously enabled until the beginning of the display period associated with the next odd-numbered gate line. Similarly, in the hold periods Hedd_MSK, as illustrated in FIG. 12, the output synchronization signals which have been last enabled in the display period Hevn associated with each of the even-numbered gate line are continuously enabled until the beginning of the display period associated with the next even-numbered gate line. It should be noted that the legends "EX" in FIGS. 11 and 12 indicate the timing at which the relevant output synchronization signals remain enabled. If not designed so, the output synchronization signals may be generated with the waveforms illustrated in FIG. 14. The operations illustrated in FIGS. 11 and 12 effectively reduces the number of switching of the source line switches SW1, SW2 and SW3 which distribute the drive signals associated with the respective subpixels to the corresponding source lines, compared with that illustrated in FIG. 14. This means that the number of charging and discharging of the signal lines transmitting the switch control signals of the source line switches SW1, SW2 and SW3 are effectively reduced. The operations illustrated in FIGS. 11 and 12 reduce the power consumption in the gate line controller 10 in this aspect.

The above-described embodiments, in which a gate halt period is inserted between an odd field period and an even field period in interlace driving and the odd-numbered gate line control signals and even-numbered gate line control signals are both deactivated in the gate halt period, effectively reduce the power consumption per unit time of the display control device 1. Additionally, the supply of the power supply voltages to the source amplifiers and other circuits of the source driver 9 is stopped in the gate halt period, and this further reduces the power consumption. Also, in time-divisionally supplying the drive signals to the display panel 3 in units of subpixel types, the switch control signals controlling the source line switches SW1, SW2 and SW3 which distributes the drive signals associated with the subpixels to the corresponding source lines are generated so that the number of switching of the source line switches SW1, SW2 and SW3 is reduced. This effectively reduces the number of charging and discharging the signal lines transmitting the switch control signals. The power consumption in the gate line controller 10 is also reduced in this aspect.

Although embodiments have been specifically described in the above, the present invention must not be construed as being limited to the above-described embodiments; the present invention may be implemented with various modifications without departing the scope set forth below.

For example, although the above-described embodiments recite that the source lines switches are driven with the output synchronization signals ODD_SW1 to ODD_SW3 and EVN_SW1 to EVN_SW3 from both sides of the source line switch circuit 23 as illustrated in FIG. 4 and therefore the output synchronization signals ODD_SW1 to ODD_SW3 are in phase with the output synchronization signals EVN_SW1 to EVN_SW3, the present invention is not limited to this configuration. The source line switch circuit 23 may be driven from one side. In this case, the phases of the output synchronization signals ODD_SW1 to ODD_SW3 and EVN_SW1 to EVN_SW3 may be shifted between the odd field periods and even field periods.

The gate line control signals are not limited to include two-phase clock signals; the gate line control signals may include three or more phase clock signals. The gate line control signals are not limited to include shift clocks supplied to shift registers; the gate line control signals may be used for control of decoders or other desired purposes.

The display control device is not limited to that which only has the display control function. The display control device may incorporate a touch panel controller achieving touch sensing of a touch panel disposed on the display panel, or incorporate a local processor or other circuit modules. The display control device may be implemented as one chip device; the display control device may be implemented as a multi-chip module in which multiple chips are packaged, being mounted on a module substrate.

The display panel driven by the display control device is not limited to a liquid crystal display; the display control device may drive an electroluminescence display panel or a plasma display panel.

What is claimed is:

1. A display control device, comprising:

a gate line controller configured control selection of gate lines of a display panel in synchronization with display timing;

a source driver configured to supply drive signals to source lines arranged to intersect the gate lines of the display panel; and a control circuitry configured to control the gate line controller and the source driver, wherein the gate line controller separately outputs odd-numbered gate line control signals used for controlling selection of odd-numbered gate lines of the display panel and even-numbered gate line control signals used for controlling selection of even-numbered gate lines, wherein the control circuitry is configured to:

perform, in response to a non-interlace mode being specified, a control to sequentially activate the odd-numbered gate line control signals and the even-numbered gate line control signals in units of gate lines, perform, in response to an interlace mode being specified, a control to alternately provide odd field periods and even field periods, and perform, in response to an interval interlace mode being specified, a control to provide a gate halt period between every adjacent two of the odd and even field periods provided alternately, wherein, in the odd field periods, the odd-numbered gate line control signals are sequentially activated with the even-numbered gate line control signals deactivated, wherein, in the even field periods, the even-numbered gate line control signals are sequentially activated with the odd-numbered gate line control signals deactivated, and wherein, in the gate halt period, the odd- and even-numbered gate line control signals are both deactivated.

2. The display control device according to claim 1, wherein the control circuitry is configured to perform a control to halt of supply of a power supply voltage to the source driver in the gate halt period.

3. The display control device according to claim 1, wherein the control circuitry is configured to perform a control to, when any one of the interlace mode and the interval interlace mode is specified, halt the supply of a power supply voltage to the source driver in a period in which the even-numbered gate line control signals are deactivated in each of the odd field periods, and halt the supply of the power supply voltage to the source driver in a period in which the odd-numbered gate line control signals are deactivated in each of the even field periods.

4. The display control device according to claim 1, further comprising a halt period setting register to which a gate halt period data is rewritably set, wherein the control circuitry is configured to control a duration of the gate halt period in response to the gate halt period data set to the halt period setting register.

5. The display control device according to claim 1, wherein the odd-numbered gate line control signals include multi-phase odd shift clock signals for sequentially shifting odd shift data from a first stage to a final stage of an odd shift register, the odd shift data used for selection of the odd-numbered gate lines, wherein the even-numbered gate line control signals include multi-phase even shift clock signals for sequentially shifting an even shift data from a first stage to a final stage of an even shift register, and wherein the deactivation of the gate line control signals is achieved by stopping switching of signal levels of the multi-phase odd shift clock signals and the multi-phase even shift clock signals.

6. The display control device according to claim 1, wherein the source driver time-divisionally outputs drive signals to subpixels associated with each gate line from drive terminals in units of subpixel types in each display period associated with each gate line, wherein the gate line controller outputs output synchronization signals each specifying an output period in which the drive signals for a corresponding one of the subpixel types are time-divisionally output from the drive terminals, wherein, in all of the non-interlace mode, interlace mode and the interval interlace mode, the control circuitry performs a control to first enable the output synchronization signal which has been last enabled in a display period associated with a specific gate line in the display period associated with the gate line next to the specific gate line, so that the output synchronization signal which has been last enabled in the display period associated with the specific gate line remains enabled until a beginning of the display period associated with the gate line next to the specific gate line.

7. The display control device according to claim 6, wherein in response to the interlace mode or interval interlace mode being specified, the control circuitry is configured to perform a control to, in each of the odd field periods, first enable the output synchronization signal which has been last enabled in the display period associated with each of the odd-numbered gate lines in the display period associated with the next odd-numbered gate line, so that the output synchronization signal which has been last enabled in the display period associated with each of the odd-numbered gate lines remain enabled until the display period associated with the next odd-numbered gate line, and a control to, in each of the even field periods, first enable the output synchronization signal which has been last enabled in the display period associated with each of the even-numbered gate lines in the display period associated with the next even-numbered gate line, so that the output synchronization signal which has been last enabled in the display period associated with each of the even-numbered gate lines remain enabled until the display period associated with the next even-numbered gate line.

8. A display panel module, comprising:

a display panel; and a display control device including:

a gate line controller configured to control selection of gate lines of the display panel in synchronization with display timing;

a source driver configured to supply drive signals in parallel to source lines arranged to intersect the gate lines of the display panel; and a control circuitry configured to control the gate line controller and the source driver, wherein the gate line controller separately outputs odd-numbered gate line control signals used to for controlling selection of odd-numbered gate lines of the display panel and even-numbered gate line control signals used for controlling selection of even-numbered gate lines, wherein the control circuitry is configured to perform, in response to a non-interlace mode being specified, a control to sequentially activate the odd-numbered gate line control signals and the even-numbered gate line control signals in units of gate lines, perform, in response to an interlace mode being specified, a control to alternately provide odd field periods and even field periods and perform, in response to an interval interlace mode being specified, a control to provide a gate halt period between adjacent two of the odd and even field periods which are alternately provided, wherein, in the odd field periods, the odd-numbered gate line control signals are sequentially activated with the even-numbered gate line control signals deactivated, wherein, in the even field periods, the even-numbered gate line control signals are sequentially activated with the odd-numbered gate line control signals deactivated, and wherein, in the gate halt period, the odd- and even-numbered gate line control signals are both deactivated.

9. The display panel module according to claim 8, wherein the control circuitry is configured to perform a control to halt of supply of a power supply voltage to the source driver in the gate halt period.

10. The display panel module according to claim 8, wherein the control circuitry is configured to perform a control to, when any one of the interlace mode and the interval interlace mode is specified, halt the supply of the power supply voltage to the source driver in a period in which the even-numbered gate line control signals are deactivated in each of the odd field periods, and halt the supply of the power supply voltage to the source driver in a period in which the odd-numbered gate line control signals are deactivated in each of the even field periods.

11. The display panel module according to claim 8, further comprising a halt period setting register to which a gate halt period data is rewritably set, wherein the control circuitry is configured to control a duration of the gate halt period in response to the gate halt period data set to the halt period setting register.

12. The display panel module according to claim 8, wherein the display panel includes:

an odd gate driver configured to select odd-numbered gate lines in response to an odd shift data shifted over an odd shift register; and an even gate driver configured to select even-numbered gate lines in response to an even shift data shifted over an even shift register, wherein the odd-numbered gate line control signals include multi-phase odd shift clock signals for sequentially shifting the odd shift data from a first stage to final stage of the odd shift register, the odd shift data used for selection of the odd-numbered gate lines, wherein the even-numbered gate line control signals include multi-phase even shift clock signals for sequentially shifting the even shift data from a first stage to final stage of the even shift register, and wherein the deactivation of the odd-numbered gate line control signals and the even-numbered gate line control signals is achieved by stopping switching of signal levels of the odd shift clock signals and the even shift clock signals.

13. The display panel module according to claim 8, wherein the source driver time-divisionally outputs drive signals to pixels associated with each gate line from drive terminals in units of subpixel types in each display period associated with each gate line, wherein the gate line controller outputs output synchronization signals each specifying an output period in which the drive signals of a corresponding one of the subpixel types are to be time-divisionally output from the drive terminals, wherein the display panel includes a source line switch circuit which distribute the drive signals time-divisionally output from the drive terminals to source lines corresponding to respective subpixels, wherein the source line switch circuit uses the output synchronization signals as switch control signals for the respective subpixel types, and wherein, in all of the non-interlace mode, the interlace mode and the interval interlace mode, the control circuitry performs a control to first enable the output synchronization signal which have been last enabled in a display period associated with a specific gate line in the display period associated with the gate line next to the specific gate line, so that the output synchronization signal which has been last enabled in the display period associated with the specific gate line remains enabled until a beginning of the display period associated with the gate line next to the specific gate line.

14. The display panel module according to claim 13, wherein in response to the interlace or interval interlace mode being specified, the control circuitry perform a control to, in each of the odd field periods, first enable the output synchronization signal which has been last enabled in the display period associated with each of the odd-numbered gate lines in the display period associated with the next odd-numbered gate line, so that the output synchronization signal which has been last enabled in the display period associated with each of the odd-numbered gate lines remain enabled until the display period associated with the next odd-numbered gate line, and a control to, in each of the even field periods, first enable the output synchronization signal which has been last enabled in the display period associated with each of the even-numbered gate lines in the display period associated with the next even-numbered gate line, so that the output synchronization signal which has been last enabled in the display period associated with each of the even-numbered gate lines remain enabled until the display period associated with the next even-numbered gate line.

15. A display control device, comprising:

a gate line controller configured control selection of gate lines of a display panel in synchronization with display timing;

a source driver configured to supply drive signals to source lines arranged to intersect the gate lines of the display panel; and a control circuitry configured to control the gate line controller and the source driver, wherein the gate line controller separately outputs odd-numbered gate line control signals used to for controlling selection of odd-numbered gate lines of the display panel and even-numbered gate line control signals used for controlling selection of even-numbered gate lines, wherein the control circuitry is configured to perform, in response to a non-interlace mode being specified, a control to sequentially activate the odd-numbered gate line control signals and the even-numbered gate line control signals in units of gate lines, and perform, in response to an interlace mode being specified, a control to alternately provide odd field periods and even field periods, wherein, in the odd field periods, the odd-numbered gate line control signals are sequentially activated and the activation of even-numbered gate line control signals is masked, wherein, in the even field periods, the even-numbered gate line control signals are sequentially activated and the activation of the odd-numbered gate line control signals is masked, wherein the source driver time-divisionally outputs drive signals to subpixels associated with each gate line from drive terminals in units of subpixel types in each display period associated with each gate line, wherein the gate line controller outputs output synchronization signals each specifying an output period in which the drive signals for corresponding one of the subpixel types are to be time-divisionally output from the drive terminals, wherein, in response to the interlace or interval interlace mode being specified, the control circuitry performs a control to, in each of the odd field periods, first enable the output synchronization signal which has been last enabled in the display period associated with each of the odd-numbered gate lines in the display period associated with the next odd-numbered gate line, so that the output synchronization signal which has been last enabled in the display period associated with each of the odd-numbered gate lines remain enabled until the display period associated with the next odd-numbered gate line, and a control to, in each of the even field periods, first enable the output synchronization signal which has been last enable in the display period associated with each of the even-numbered gate lines in the display period associated with the next even-numbered gate line, so that the output synchronization signal which has been last enabled in the display period associated with each of the even-numbered gate lines remain enabled until the display period associated with the next even-numbered gate line.

16. A display panel module, comprising:

a display panel; and a display control device including:

a gate line controller configured to control selection of gate lines of the display panel in synchronization with display timing;

a source driver configured to supply drive signals in parallel to source lines arranged to intersect the gate lines of the display panel; and a control circuitry configured to control the gate line controller and the source driver, wherein the gate line controller separately outputs odd-numbered gate line control signals used to for controlling selection of odd-numbered gate lines of the display panel and even-numbered gate line control signals used for controlling selection of even-numbered gate lines, wherein the control circuitry is configured to perform, in response to a non-interlace mode being specified, a control to sequentially activate the odd-numbered gate line control signals and the even-numbered gate line control signals in units of gate lines, and perform, in response to an interlace mode being specified, a control to alternately provide odd field periods and even field periods, wherein, in the odd field periods, the odd-numbered gate line control signals are sequentially activated and the activation of even-numbered gate line control signals is masked, wherein, in the even field periods, the even-numbered gate line control signals are sequentially activated and the activation of the odd-numbered gate line control signals is masked, wherein the source driver time-divisionally outputs drive signals to subpixels associated with each gate line from drive terminals in units of subpixel types in each display period associated with each gate line, wherein the gate line controller outputs output synchronization signals each specifying an output period in which the drive signals for corresponding one of the subpixel types are to be time-divisionally output from the drive terminals, wherein the display panel includes a source line switch circuit which distribute the drive signals time-divisionally output from the drive terminals to source lines corresponding to respective subpixels, and wherein the source line switch circuit uses the output synchronization signals as switch control signals for the respective subpixel types, wherein the control circuitry performs a control to, in each of the odd field periods, first enable the output synchronization signal which has been last enabled in the display period associated with each of the odd-numbered gate lines in the display period associated with the next odd-numbered gate line, so that the output synchronization signal which has been last enabled in the display period associated with each of the odd-numbered gate lines remain enabled until the display period associated with the next odd-numbered gate line, and a control to, in each of the even field periods, first enable the output synchronization signal which has been last enabled in the display period associated with each of the even-numbered gate lines in the display period associated with the next even-numbered gate line, so that the output synchronization signal which has been last enabled in the display period associated with each of the even-numbered gate lines remain enabled until the display period associated with the next even-numbered gate line.

* * * * *